US008584972B2

(12) United States Patent
Luettgen et al.

(10) Patent No.: US 8,584,972 B2
(45) Date of Patent: Nov. 19, 2013

(54) HANDHELD SHOWERHEAD WITH FLUID PASSAGEWAYS

(75) Inventors: Harold A. Luettgen, Windsor, CO (US); Leland C. Leber, Fort Collins, CO (US); Michael J. Quinn, Windsor, CO (US)

(73) Assignee: Water Pik, Inc., Fort Collins, CO (US)

( * ) Notice: Subject to any disclaimer, the term of this patent is extended or adjusted under 35 U.S.C. 154(b) by 0 days.

(21) Appl. No.: 13/270,060

(22) Filed: Oct. 10, 2011

(65) Prior Publication Data

US 2012/0085839 A1 Apr. 12, 2012

Related U.S. Application Data

(63) Continuation of application No. 12/870,032, filed on Aug. 27, 2010, now Pat. No. 8,146,838, which is a continuation of application No. 11/669,132, filed on Jan. 30, 2007, now Pat. No. 7,789,326.

(60) Provisional application No. 60/882,898, filed on Dec. 29, 2006.

(51) Int. Cl.

| | |
|---|---|
| ***B05B 1/18*** | (2006.01) |
| ***B05B 1/16*** | (2006.01) |
| ***B05B 1/14*** | (2006.01) |
| ***B05B 7/02*** | (2006.01) |

(52) U.S. Cl.

USPC ..... 239/447; 239/443; 239/444; 239/449; 239/525; 239/562; 239/567

(58) Field of Classification Search

USPC ..... 239/309–394, 396, 436, 443, 444, 239/446–449, 525, 530, 532, 536, 548, 239/558–562, 567

See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |

(Continued)

FOREIGN PATENT DOCUMENTS

| | | |
|---|---|---|
| CA | 659510 | 3/1963 |
| CA | 2341041 | 8/1999 |

(Continued)

OTHER PUBLICATIONS

Author Unknown, "Flipside: The Bold Look of Kohler," 1 page, at least as early as Jun. 2011.

(Continued)

*Primary Examiner* — Darren W Gorman
(74) *Attorney, Agent, or Firm* — Dorsey & Whitney LLP

(57) ABSTRACT

A handheld showerhead includes a showerhead portion and a handle portion. The showerhead portion includes a plurality of nozzles. At least two fluid channels are defined in part by at least two walls that are adjacent and parallel to each other and a curved wall that extends between edges of the at least two walls. A base wall is operably associated with the at least two walls and defines two or more fluid channel inlets each in fluid communication with a respective one of the two more fluid channels. The handle portion is operatively associated with the showerhead portion, and includes at least one of a fluid inlet and a fluid passage, and including a rotatable mode selector.

21 Claims, 23 Drawing Sheets

(56) References Cited

U.S. PATENT DOCUMENTS

| | | | |
|---|---|---|---|
| 309,349 | A | 12/1884 | Hart |
| 428,023 | A | 5/1890 | Schoff |
| 432,712 | A | 7/1890 | Taylor |
| 445,250 | A | 1/1891 | Lawless |
| 453,109 | A | 5/1891 | Dreisorner |
| 486,986 | A | 11/1892 | Schinke |
| 566,384 | A | 8/1896 | Engelhart |
| 566,410 | A | 8/1896 | Schinke |
| 570,405 | A | 10/1896 | Jerguson et al. |
| 694,888 | A | 3/1902 | Pfluger |
| 800,802 | A | 10/1905 | Franquist |
| 832,523 | A | 10/1906 | Andersson |
| 835,678 | A | 11/1906 | Hammond |
| 845,540 | A | 2/1907 | Ferguson |
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |
| 1,046,573 | A | 12/1912 | Ellis |
| 1,130,520 | A | 3/1915 | Kenney |
| 1,203,466 | A | 10/1916 | Benson |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,459,582 | A | 6/1923 | Dubee |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,633,531 | A | 6/1927 | Keller |
| 1,692,394 | A | 11/1928 | Sundh |
| 1,695,263 | A | 12/1928 | Jacques |
| 1,724,147 | A | 8/1929 | Russell |
| 1,724,161 | A | 8/1929 | Wuesthoff |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,849,517 | A | 3/1932 | Fraser |
| 1,890,156 | A | 12/1932 | Konig |
| 1,906,575 | A | 5/1933 | Goeriz |
| 1,934,553 | A | 11/1933 | Mueller et al. |
| 1,946,207 | A | 2/1934 | Haire |
| 2,011,446 | A | 8/1935 | Judell |
| 2,024,930 | A | 12/1935 | Judell |
| 2,033,467 | A | 3/1936 | Groeniger |
| 2,044,445 | A | 6/1936 | Price et al. |
| 2,085,854 | A | 7/1937 | Hathaway et al. |
| 2,096,912 | A | 10/1937 | Morris |
| 2,117,152 | A | 5/1938 | Crosti |
| D113,439 | S | 2/1939 | Reinecke |
| 2,196,783 | A | 4/1940 | Shook |
| 2,197,667 | A | 4/1940 | Shook |
| 2,216,149 | A | 10/1940 | Weiss |
| D126,433 | S | 4/1941 | Enthof |
| 2,251,192 | A | 7/1941 | Krumsiek et al. |
| 2,268,263 | A | 12/1941 | Newell et al. |
| 2,285,831 | A | 6/1942 | Pennypacker |
| 2,342,757 | A | 2/1944 | Roser |
| 2,402,741 | A | 6/1946 | Draviner |
| D147,258 | S | 8/1947 | Becker |
| D152,584 | S | 2/1949 | Becker |
| 2,467,954 | A | 4/1949 | Becker |
| 2,546,348 | A | 3/1951 | Schuman |
| 2,567,642 | A | 9/1951 | Penshaw |
| 2,581,129 | A | 1/1952 | Muldoon |
| D166,073 | S | 3/1952 | Dunkelberger |
| 2,648,762 | A | 8/1953 | Dunkelberger |
| 2,664,271 | A | 12/1953 | Arutunoff |
| 2,671,693 | A | 3/1954 | Hyser et al. |
| 2,676,806 | A | 4/1954 | Bachman |
| 2,679,575 | A | 5/1954 | Haberstump |
| 2,680,358 | A | 6/1954 | Zublin |
| 2,726,120 | A | 12/1955 | Bletcher et al. |
| 2,759,765 | A | 8/1956 | Pawley |
| 2,776,168 | A | 1/1957 | Schweda |
| 2,792,847 | A | 5/1957 | Spencer |
| 2,873,999 | A | 2/1959 | Webb |
| 2,930,505 | A | 3/1960 | Meyer |
| 2,931,672 | A | 4/1960 | Merritt et al. |
| 2,935,265 | A | 5/1960 | Richter |
| 2,949,242 | A | 8/1960 | Blumberg et al. |
| 2,957,587 | A | 10/1960 | Tobin |
| 2,966,311 | A | 12/1960 | Davis |
| D190,295 | S | 5/1961 | Becker |
| 2,992,437 | A | 7/1961 | Nelson et al. |
| 3,007,648 | A | 11/1961 | Fraser |
| D192,935 | S | 5/1962 | Becker |
| 3,032,357 | A | 5/1962 | Shames et al. |
| 3,034,809 | A | 5/1962 | Greenberg |
| 3,037,799 | A | 6/1962 | Mulac |
| 3,081,339 | A | 3/1963 | Green et al. |
| 3,092,333 | A | 6/1963 | Gaiotto |
| 3,098,508 | A | 7/1963 | Gerdes |
| 3,103,723 | A | 9/1963 | Becker |
| 3,104,815 | A | 9/1963 | Schultz |
| 3,104,827 | A | 9/1963 | Aghnides |
| 3,111,277 | A | 11/1963 | Grimsley |
| 3,112,073 | A | 11/1963 | Larson et al. |
| 3,143,857 | A | 8/1964 | Eaton |
| 3,196,463 | A | 7/1965 | Farneth |
| 3,231,200 | A | 1/1966 | Heald |
| 3,236,545 | A | 2/1966 | Parkes et al. |
| 3,239,152 | A | 3/1966 | Bachli et al. |
| 3,266,059 | A | 8/1966 | Stelle |
| 3,272,437 | A | 9/1966 | Coson |
| 3,273,359 | A | 9/1966 | Fregeolle |
| 3,306,634 | A | 2/1967 | Groves et al. |
| 3,323,148 | A | 6/1967 | Burnon |
| 3,329,967 | A | 7/1967 | Martinez et al. |
| 3,341,132 | A | 9/1967 | Parkison |
| 3,342,419 | A | 9/1967 | Weese |
| 3,344,994 | A | 10/1967 | Fife |
| 3,363,842 | A | 1/1968 | Burns |
| 3,383,051 | A | 5/1968 | Fiorentino |
| 3,389,925 | A | 6/1968 | Gottschald |
| 3,393,311 | A | 7/1968 | Dahl |
| 3,393,312 | A | 7/1968 | Dahl |
| 3,404,410 | A | 10/1968 | Sumida |
| 3,492,029 | A | 1/1970 | French et al. |
| 3,516,611 | A | 6/1970 | Piggott |
| 3,546,961 | A | 12/1970 | Marton |
| 3,550,863 | A | 12/1970 | McDermott |
| 3,552,436 | A | 1/1971 | Stewart |
| 3,565,116 | A | 2/1971 | Gabin |
| 3,566,917 | A | 3/1971 | White |
| 3,580,513 | A | 5/1971 | Martin |
| 3,584,822 | A | 6/1971 | Oram |
| 3,596,835 | A | 8/1971 | Smith et al. |
| 3,612,577 | A | 10/1971 | Pope et al. |
| 3,637,143 | A | 1/1972 | Shames et al. |
| 3,641,333 | A | 2/1972 | Gendron |
| 3,647,144 | A | 3/1972 | Parkison et al. |
| 3,663,044 | A | 5/1972 | Contreras et al. |
| 3,669,470 | A | 6/1972 | Deurloo |
| 3,672,648 | A | 6/1972 | Price |
| 3,682,392 | A | 8/1972 | Kint |
| 3,685,745 | A | 8/1972 | Peschcke-koedt |
| D224,834 | S | 9/1972 | Laudell |
| 3,711,029 | A | 1/1973 | Bartlett |
| 3,722,798 | A | 3/1973 | Bletcher et al. |
| 3,722,799 | A | 3/1973 | Rauh |
| 3,731,084 | A | 5/1973 | Trevorrow |
| 3,754,779 | A | 8/1973 | Peress |
| D228,622 | S | 10/1973 | Juhlin |
| 3,762,648 | A | 10/1973 | Deines et al. |
| 3,768,735 | A | 10/1973 | Ward |

(56) References Cited

U.S. PATENT DOCUMENTS 3,786,995 A 1/1974 Manoogian et al.
3,801,019 A 4/1974 Trenary et al.
3,810,580 A 5/1974 Rauh
3,826,454 A 7/1974 Zieger
3,840,734 A 10/1974 Oram
3,845,291 A 10/1974 Portyrata
3,860,271 A 1/1975 Rodgers
3,861,719 A 1/1975 Hand
3,865,310 A 2/1975 Elkins et al.
3,869,151 A 3/1975 Fletcher et al.
3,896,845 A 7/1975 Parker
3,902,671 A 9/1975 Symmons
3,910,277 A 10/1975 Zimmer
D237,708 S 11/1975 Grohe
3,929,164 A 12/1975 Richter
3,929,287 A 12/1975 Givler et al.
3,958,756 A 5/1976 Trenary et al.
D240,322 S 6/1976 Staub
3,963,179 A 6/1976 Tomaro
3,967,783 A 7/1976 Halsted et al.
3,979,096 A 9/1976 Zieger
3,997,116 A 12/1976 Moen
3,998,390 A 12/1976 Peterson et al.
3,999,714 A 12/1976 Lang
4,005,880 A 2/1977 Anderson et al.
4,006,920 A 2/1977 Sadler et al.
4,023,782 A 5/1977 Eifer
4,042,984 A 8/1977 Butler
4,045,054 A 8/1977 Arnold
D245,858 S 9/1977 Grube
D245,860 S 9/1977 Grube
4,068,801 A 1/1978 Leutheuser
4,081,135 A 3/1978 Tomaro
4,084,271 A 4/1978 Ginsberg
4,091,998 A 5/1978 Peterson
D249,356 S 9/1978 Nagy
4,117,979 A 10/1978 Lagarelli et al.
4,129,257 A 12/1978 Eggert
4,130,120 A 12/1978 Kohler, Jr.
4,131,233 A 12/1978 Koenig
4,133,486 A 1/1979 Fanella
4,135,549 A 1/1979 Baker
D251,045 S 2/1979 Grube
4,141,502 A 2/1979 Grohe
4,151,955 A 5/1979 Stouffer
4,151,957 A 5/1979 Gecewicz et al.
4,162,801 A 7/1979 Kresky et al.
4,165,837 A 8/1979 Rundzaitis
4,167,196 A 9/1979 Morris
4,174,822 A 11/1979 Larsson
4,185,781 A 1/1980 O'Brien
4,190,207 A 2/1980 Fienhold et al.
4,191,332 A 3/1980 De Langis et al.
4,203,550 A 5/1980 On
4,209,132 A 6/1980 Kwan
D255,626 S 7/1980 Grube
4,219,160 A 8/1980 Allred, Jr.
4,221,338 A 9/1980 Shames et al.
4,239,409 A 12/1980 Osrwo
4,243,253 A 1/1981 Rogers, Jr.
4,244,526 A 1/1981 Arth
D258,677 S 3/1981 Larsson
4,254,914 A 3/1981 Shames et al.
4,258,414 A 3/1981 Sokol
4,272,022 A 6/1981 Evans
4,274,400 A 6/1981 Baus
4,282,612 A 8/1981 King
D261,300 S 10/1981 Klose
D261,417 S 10/1981 Klose
4,303,201 A 12/1981 Elkins et al.
4,319,608 A 3/1982 Raikov et al.
4,330,089 A 5/1982 Finkbeiner
D266,212 S 9/1982 Haug et al.
4,350,298 A 9/1982 Tada
4,353,508 A 10/1982 Butterfield et al.
4,358,056 A 11/1982 Greenhut et al.
D267,582 S 1/1983 Mackay et al.
D268,359 S 3/1983 Klose
D268,442 S 3/1983 Darmon
D268,611 S 4/1983 Klose
4,383,554 A 5/1983 Merriman
4,396,797 A 8/1983 Sakuragi et al.
4,398,669 A 8/1983 Fienhold
4,425,965 A 1/1984 Bayh, III et al.
4,432,392 A 2/1984 Paley
D274,457 S 6/1984 Haug
4,461,052 A 7/1984 Mostul
4,465,308 A 8/1984 Martini
4,467,964 A 8/1984 Kaeser
4,495,550 A 1/1985 Visciano
4,527,745 A 7/1985 Butterfield et al.
4,540,202 A 9/1985 Amphoux et al.
4,545,081 A 10/1985 Nestor et al.
4,553,775 A 11/1985 Halling
D281,820 S 12/1985 Oba et al.
4,561,593 A 12/1985 Cammack et al.
4,564,889 A 1/1986 Bolson
4,571,003 A 2/1986 Roling et al.
4,572,232 A 2/1986 Gruber
D283,645 S 4/1986 Tanaka
4,587,991 A 5/1986 Chorkey
4,588,130 A 5/1986 Trenary et al.
4,598,866 A 7/1986 Cammack et al.
4,614,303 A 9/1986 Moseley, Jr. et al.
4,616,298 A 10/1986 Bolson
4,618,100 A 10/1986 White et al.
4,629,124 A 12/1986 Gruber
4,629,125 A 12/1986 Liu
4,643,463 A 2/1987 Halling et al.
4,645,244 A 2/1987 Curtis
RE32,386 E 3/1987 Hunter
4,650,120 A 3/1987 Kress
4,650,470 A 3/1987 Epstein
4,652,025 A 3/1987 Conroy, Sr.
4,654,900 A 4/1987 McGhee
4,657,185 A 4/1987 Rundzaitis
4,669,666 A 6/1987 Finkbeiner
4,669,757 A 6/1987 Bartholomew
4,674,687 A 6/1987 Smith et al.
4,683,917 A 8/1987 Bartholomew
4,703,893 A 11/1987 Gruber
4,717,180 A 1/1988 Roman
4,719,654 A 1/1988 Blessing
4,733,337 A 3/1988 Bieberstein
D295,437 S 4/1988 Fabian
4,739,801 A 4/1988 Kimura et al.
4,749,126 A 6/1988 Kessener et al.
D296,582 S 7/1988 Haug et al.
4,754,928 A 7/1988 Rogers et al.
D297,160 S 8/1988 Robbins
4,764,047 A 8/1988 Johnston et al.
4,778,104 A 10/1988 Fisher
4,787,591 A 11/1988 Villacorta
4,790,294 A 12/1988 Allred, III et al.
4,801,091 A 1/1989 Sandvik
4,809,369 A 3/1989 Bowden
4,839,599 A 6/1989 Fischer
4,842,059 A 6/1989 Tomek
D302,325 S 7/1989 Charet et al.
4,850,616 A 7/1989 Pava
4,854,499 A 8/1989 Neuman
4,856,822 A 8/1989 Parker
4,865,362 A 9/1989 Holden
D303,830 S 10/1989 Ramsey et al.
4,871,196 A 10/1989 Kingsford
4,896,658 A 1/1990 Yonekubo et al.
D306,351 S 2/1990 Charet et al.
4,901,927 A 2/1990 Valdivia
4,903,178 A 2/1990 Englot et al.
4,903,897 A 2/1990 Hayes
4,903,922 A 2/1990 Harris, III
4,907,137 A 3/1990 Schladitz et al.
4,907,744 A * 3/1990 Jousson ..... 239/449
4,909,435 A 3/1990 Kidouchi et al.

(56) References Cited

U.S. PATENT DOCUMENTS

| | | | |
|---|---|---|---|
| 4,914,759 | A | 4/1990 | Goff |
| 4,946,202 | A | 8/1990 | Perricone |
| 4,951,329 | A | 8/1990 | Shaw |
| 4,953,585 | A | 9/1990 | Rollini et al. |
| 4,964,573 | A | 10/1990 | Lipski |
| 4,972,048 | A | 11/1990 | Martin |
| D313,267 | S | 12/1990 | Lenci et al. |
| 4,976,460 | A | 12/1990 | Newcombe et al. |
| D314,246 | S | 1/1991 | Bache |
| D315,191 | S | 3/1991 | Mikol |
| 4,998,673 | A | 3/1991 | Pilolla |
| 5,004,158 | A | 4/1991 | Halem et al. |
| D317,348 | S | 6/1991 | Geneve et al. |
| 5,020,570 | A | 6/1991 | Cotter |
| 5,022,103 | A | 6/1991 | Faist |
| 5,032,015 | A | 7/1991 | Christianson |
| 5,033,528 | A | 7/1991 | Volcani |
| 5,033,897 | A | 7/1991 | Chen |
| D319,294 | S | 8/1991 | Kohler, Jr. et al. |
| D320,064 | S | 9/1991 | Presman |
| 5,046,764 | A | 9/1991 | Kimura et al. |
| D321,062 | S | 10/1991 | Bonbright |
| 5,058,804 | A | 10/1991 | Yonekubo et al. |
| D322,119 | S | 12/1991 | Haug et al. |
| D322,681 | S | 12/1991 | Yuen |
| 5,070,552 | A | 12/1991 | Gentry et al. |
| D323,545 | S | 1/1992 | Ward |
| 5,082,019 | A | 1/1992 | Tetrault |
| 5,086,878 | A | 2/1992 | Swift |
| 5,090,624 | A | 2/1992 | Rogers |
| 5,100,055 | A | 3/1992 | Rokitenetz et al. |
| D325,769 | S | 4/1992 | Haug et al. |
| D325,770 | S | 4/1992 | Haug et al. |
| 5,103,384 | A | 4/1992 | Drohan |
| D326,311 | S | 5/1992 | Lenci et al. |
| D327,115 | S | 6/1992 | Rogers |
| 5,121,511 | A | 6/1992 | Sakamoto et al. |
| D327,729 | S | 7/1992 | Rogers |
| 5,127,580 | A | 7/1992 | Fu-I |
| 5,134,251 | A | 7/1992 | Martin |
| D328,944 | S | 8/1992 | Robbins |
| 5,141,016 | A | 8/1992 | Nowicki |
| D329,504 | S | 9/1992 | Yuen |
| 5,143,300 | A | 9/1992 | Cutler |
| 5,145,114 | A | 9/1992 | Monch |
| 5,148,556 | A | 9/1992 | Bottoms et al. |
| D330,068 | S | 10/1992 | Haug et al. |
| D330,408 | S | 10/1992 | Thacker |
| D330,409 | S | 10/1992 | Raffo |
| 5,153,976 | A | 10/1992 | Benchaar et al. |
| 5,154,355 | A | 10/1992 | Gonzalez |
| 5,154,483 | A | 10/1992 | Zeller |
| 5,161,567 | A | 11/1992 | Humpert |
| 5,163,752 | A | 11/1992 | Copeland et al. |
| 5,171,429 | A | 12/1992 | Yasuo |
| 5,172,860 | A | 12/1992 | Yuch |
| 5,172,862 | A | 12/1992 | Heimann et al. |
| 5,172,866 | A | 12/1992 | Ward |
| D332,303 | S | 1/1993 | Klose |
| D332,994 | S | 2/1993 | Huen |
| D333,339 | S | 2/1993 | Klose |
| 5,197,767 | A | 3/1993 | Kimura et al. |
| D334,794 | S | 4/1993 | Klose |
| D335,171 | S | 4/1993 | Lenci et al. |
| 5,201,468 | A | 4/1993 | Freier et al. |
| 5,206,963 | A | 5/1993 | Wiens |
| 5,207,499 | A | 5/1993 | Vajda et al. |
| 5,213,267 | A | 5/1993 | Heimann et al. |
| 5,220,697 | A | 6/1993 | Birchfield |
| D337,839 | S | 7/1993 | Zeller |
| 5,228,625 | A | 7/1993 | Grassberger |
| 5,230,106 | A | 7/1993 | Henkin et al. |
| D338,542 | S | 8/1993 | Yuen |
| 5,232,162 | A | 8/1993 | Chih |
| D339,492 | S | 9/1993 | Klose |
| D339,627 | S | 9/1993 | Klose |
| D339,848 | S | 9/1993 | Gottwald |
| 5,246,169 | A | 9/1993 | Heimann et al. |
| 5,246,301 | A | 9/1993 | Hirasawa |
| D340,376 | S | 10/1993 | Klose |
| 5,253,670 | A | 10/1993 | Perrott |
| 5,253,807 | A | 10/1993 | Newbegin |
| 5,254,809 | A | 10/1993 | Martin |
| D341,007 | S | 11/1993 | Haug et al. |
| D341,191 | S | 11/1993 | Klose |
| D341,220 | S | 11/1993 | Eagan |
| 5,263,646 | A | 11/1993 | McCauley |
| 5,265,833 | A | 11/1993 | Heimann et al. |
| 5,268,826 | A | 12/1993 | Greene |
| 5,276,596 | A | 1/1994 | Krenzel |
| 5,277,391 | A | 1/1994 | Haug et al. |
| 5,286,071 | A | 2/1994 | Storage |
| 5,288,110 | A | 2/1994 | Allread |
| 5,294,054 | A | 3/1994 | Benedict et al. |
| 5,297,735 | A | 3/1994 | Heimann et al. |
| 5,297,739 | A | 3/1994 | Allen |
| D345,811 | S | 4/1994 | Van Deursen et al. |
| D346,426 | S | 4/1994 | Warshawsky |
| D346,428 | S | 4/1994 | Warshawsky |
| D346,430 | S | 4/1994 | Warshawsky |
| D347,262 | S | 5/1994 | Black et al. |
| D347,265 | S | 5/1994 | Gottwald |
| 5,316,216 | A | 5/1994 | Cammack et al. |
| D348,720 | S | 7/1994 | Haug et al. |
| 5,329,650 | A | 7/1994 | Zaccai et al. |
| D349,947 | S | 8/1994 | Hing-Wah |
| 5,333,787 | A | 8/1994 | Smith et al. |
| 5,333,789 | A | 8/1994 | Garneys |
| 5,340,064 | A | 8/1994 | Heimann et al. |
| 5,340,165 | A | 8/1994 | Sheppard |
| D350,808 | S | 9/1994 | Warshawsky |
| 5,344,080 | A | 9/1994 | Matsui |
| 5,349,987 | A | 9/1994 | Shieh |
| 5,356,076 | A | 10/1994 | Bishop |
| 5,356,077 | A | 10/1994 | Shames |
| D352,092 | S | 11/1994 | Warshawsky |
| D352,347 | S | 11/1994 | Dannenberg |
| D352,766 | S | 11/1994 | Hill et al. |
| 5,368,235 | A | 11/1994 | Drozdoff et al. |
| 5,369,556 | A | 11/1994 | Zeller |
| 5,370,427 | A | 12/1994 | Hoelle et al. |
| 5,385,500 | A | 1/1995 | Schmidt |
| D355,242 | S | 2/1995 | Warshawsky |
| D355,703 | S | 2/1995 | Duell |
| D356,626 | S | 3/1995 | Wang |
| 5,397,064 | A | 3/1995 | Heitzman |
| 5,398,872 | A | 3/1995 | Joubran |
| 5,398,977 | A | 3/1995 | Berger et al. |
| 5,402,812 | A | 4/1995 | Moineau et al. |
| 5,405,089 | A | 4/1995 | Heimann et al. |
| 5,414,879 | A | 5/1995 | Hiraishi et al. |
| 5,423,348 | A | 6/1995 | Jezek et al. |
| 5,433,384 | A | 7/1995 | Chan et al. |
| D361,399 | S | 8/1995 | Carbone et al. |
| D361,623 | S | 8/1995 | Huen |
| 5,441,075 | A | 8/1995 | Clare |
| 5,449,206 | A | 9/1995 | Lockwood |
| D363,360 | S | 10/1995 | Santarsiero |
| 5,454,809 | A | 10/1995 | Janssen |
| 5,468,057 | A | 11/1995 | Megerle et al. |
| D364,935 | S | 12/1995 | deBlois |
| D365,625 | S | 12/1995 | Bova |
| D365,646 | S | 12/1995 | deBlois |
| 5,476,225 | A | 12/1995 | Chan |
| D366,309 | S | 1/1996 | Huang |
| D366,707 | S | 1/1996 | Kaiser |
| D366,708 | S | 1/1996 | Santarsiero |
| D366,709 | S | 1/1996 | Szymanski |
| D366,710 | S | 1/1996 | Szymanski |
| 5,481,765 | A | 1/1996 | Wang |
| D366,948 | S | 2/1996 | Carbone |
| D367,315 | S | 2/1996 | Andrus |
| D367,333 | S | 2/1996 | Swyst |
| D367,696 | S | 3/1996 | Andrus |

(56) References Cited

U.S. PATENT DOCUMENTS

| | | | |
|---|---|---|---|
| D367,934 | S | 3/1996 | Carbone |
| D368,146 | S | 3/1996 | Carbone |
| D368,317 | S | 3/1996 | Swyst |
| 5,499,767 | A | 3/1996 | Morand |
| D368,539 | S | 4/1996 | Carbone et al. |
| D368,540 | S | 4/1996 | Santarsiero |
| D368,541 | S | 4/1996 | Kaiser et al. |
| D368,542 | S | 4/1996 | deBlois et al. |
| D369,204 | S | 4/1996 | Andrus |
| D369,205 | S | 4/1996 | Andrus |
| 5,507,436 | A | 4/1996 | Ruttenberg |
| D369,873 | S | 5/1996 | deBlois et al. |
| D369,874 | S | 5/1996 | Santarsiero |
| D369,875 | S | 5/1996 | Carbone |
| D370,052 | S | 5/1996 | Chan et al. |
| D370,250 | S | 5/1996 | Fawcett et al. |
| D370,277 | S | 5/1996 | Kaiser |
| D370,278 | S | 5/1996 | Nolan |
| D370,279 | S | 5/1996 | deBlois |
| D370,280 | S | 5/1996 | Kaiser |
| D370,281 | S | 5/1996 | Johnstone et al. |
| 5,517,392 | A | 5/1996 | Rousso et al. |
| 5,521,803 | A | 5/1996 | Eckert et al. |
| D370,542 | S | 6/1996 | Santarsiero |
| D370,735 | S | 6/1996 | deBlois |
| D370,987 | S | 6/1996 | Santarsiero |
| D370,988 | S | 6/1996 | Santarsiero |
| D371,448 | S | 7/1996 | Santarsiero |
| D371,618 | S | 7/1996 | Nolan |
| D371,619 | S | 7/1996 | Szymanski |
| D371,856 | S | 7/1996 | Carbone |
| D372,318 | S | 7/1996 | Szymanski |
| D372,319 | S | 7/1996 | Carbone |
| 5,531,625 | A | 7/1996 | Zhong |
| 5,539,624 | A | 7/1996 | Dougherty |
| D372,548 | S | 8/1996 | Carbone |
| D372,998 | S | 8/1996 | Carbone |
| D373,210 | S | 8/1996 | Santarsiero |
| D373,434 | S | 9/1996 | Nolan |
| D373,435 | S | 9/1996 | Nolan |
| D373,645 | S | 9/1996 | Johnstone et al. |
| D373,646 | S | 9/1996 | Szymanski et al. |
| D373,647 | S | 9/1996 | Kaiser |
| D373,648 | S | 9/1996 | Kaiser |
| D373,649 | S | 9/1996 | Carbone |
| D373,651 | S | 9/1996 | Szymanski |
| D373,652 | S | 9/1996 | Kaiser |
| 5,551,637 | A | 9/1996 | Lo |
| 5,552,973 | A | 9/1996 | Hsu |
| 5,558,278 | A | 9/1996 | Gallorini |
| D374,271 | S | 10/1996 | Fleischmann |
| D374,297 | S | 10/1996 | Kaiser |
| D374,298 | S | 10/1996 | Swyst |
| D374,299 | S | 10/1996 | Carbone |
| D374,493 | S | 10/1996 | Szymanski |
| D374,494 | S | 10/1996 | Santarsiero |
| D374,732 | S | 10/1996 | Kaiser |
| D374,733 | S | 10/1996 | Santasiero |
| 5,560,548 | A | 10/1996 | Mueller et al. |
| 5,567,115 | A | 10/1996 | Carbone |
| D375,541 | S | 11/1996 | Michaluk |
| 5,577,664 | A | 11/1996 | Heitzman |
| D376,217 | S | 12/1996 | Kaiser |
| D376,860 | S | 12/1996 | Santarsiero |
| D376,861 | S | 12/1996 | Johnstone et al. |
| D376,862 | S | 12/1996 | Carbone |
| 5,605,173 | A | 2/1997 | Arnaud |
| D378,401 | S | 3/1997 | Neufeld et al. |
| 5,613,638 | A | 3/1997 | Blessing |
| 5,613,639 | A | 3/1997 | Storm et al. |
| 5,615,837 | A | 4/1997 | Roman |
| 5,624,074 | A | 4/1997 | Parisi |
| 5,624,498 | A | 4/1997 | Lee et al. |
| D379,212 | S | 5/1997 | Chan |
| D379,404 | S | 5/1997 | Spelts |
| 5,632,049 | A | 5/1997 | Chen |
| D381,405 | S | 7/1997 | Waidele et al. |
| D381,737 | S | 7/1997 | Chan |
| D382,936 | S | 8/1997 | Shfaram |
| 5,653,260 | A | 8/1997 | Huber |
| 5,667,146 | A | 9/1997 | Pimentel et al. |
| D385,332 | S | 10/1997 | Andrus |
| D385,333 | S | 10/1997 | Caroen et al. |
| D385,334 | S | 10/1997 | Caroen et al. |
| D385,616 | S | 10/1997 | Dow et al. |
| D385,947 | S | 11/1997 | Dow et al. |
| D387,230 | S | 12/1997 | von Buelow et al. |
| 5,697,557 | A | 12/1997 | Blessing et al. |
| 5,699,964 | A | 12/1997 | Bergmann et al. |
| 5,702,057 | A | 12/1997 | Huber |
| D389,558 | S | 1/1998 | Andrus |
| 5,704,080 | A | 1/1998 | Kuhne |
| 5,707,011 | A | 1/1998 | Bosio |
| 5,718,380 | A | 2/1998 | Schorn et al. |
| D392,369 | S | 3/1998 | Chan |
| 5,730,361 | A | 3/1998 | Thonnes |
| 5,730,362 | A | 3/1998 | Cordes |
| 5,730,363 | A | 3/1998 | Kress |
| 5,742,961 | A | 4/1998 | Casperson et al. |
| D394,490 | S | 5/1998 | Andrus et al. |
| 5,746,375 | A | 5/1998 | Guo |
| 5,749,552 | A | 5/1998 | Fan |
| 5,749,602 | A | 5/1998 | Delaney et al. |
| D394,899 | S | 6/1998 | Caroen et al. |
| D395,074 | S | 6/1998 | Neibrook et al. |
| D395,075 | S | 6/1998 | Kolada |
| D395,142 | S | 6/1998 | Neibrook |
| 5,764,760 | A | 6/1998 | Grandbert et al. |
| 5,765,760 | A | 6/1998 | Kuo |
| 5,769,802 | A | 6/1998 | Wang |
| 5,772,120 | A | 6/1998 | Huber |
| 5,778,939 | A | 7/1998 | Hok-Yin |
| 5,788,157 | A | 8/1998 | Kress |
| D398,370 | S | 9/1998 | Purdy |
| 5,806,771 | A | 9/1998 | Loschelder et al. |
| 5,819,791 | A | 10/1998 | Chronister et al. |
| 5,820,574 | A | 10/1998 | Henkin et al. |
| 5,823,431 | A | 10/1998 | Pierce |
| 5,823,442 | A | 10/1998 | Guo |
| 5,826,803 | A | 10/1998 | Cooper |
| 5,833,138 | A | 11/1998 | Crane et al. |
| 5,839,666 | A | 11/1998 | Heimann et al. |
| D402,350 | S | 12/1998 | Andrus et al. |
| D403,754 | S | 1/1999 | Gottwald |
| D404,116 | S | 1/1999 | Bosio |
| 5,855,348 | A | 1/1999 | Fornara |
| 5,860,599 | A | 1/1999 | Lin |
| 5,862,543 | A | 1/1999 | Reynoso et al. |
| 5,862,985 | A | 1/1999 | Neibrook et al. |
| D405,502 | S | 2/1999 | Tse |
| 5,865,375 | A | 2/1999 | Hsu |
| 5,865,378 | A | 2/1999 | Hollinshead et al. |
| 5,873,647 | A | 2/1999 | Kurtz et al. |
| D408,893 | S | 4/1999 | Tse |
| D409,276 | S | 5/1999 | Ratzlaff |
| D410,276 | S | 5/1999 | Ben-Tsur |
| 5,918,809 | A | 7/1999 | Simmons |
| 5,918,811 | A | 7/1999 | Denham et al. |
| D413,157 | S | 8/1999 | Ratzlaff |
| 5,937,905 | A | 8/1999 | Santos |
| 5,938,123 | A | 8/1999 | Heitzman |
| 5,941,462 | A | 8/1999 | Sandor |
| 5,947,388 | A | 9/1999 | Woodruff |
| D415,247 | S | 10/1999 | Haverstraw et al. |
| 5,961,046 | A | 10/1999 | Joubran |
| 5,967,417 | A | 10/1999 | Mantel |
| 5,979,776 | A | 11/1999 | Williams |
| 5,992,762 | A | 11/1999 | Wang |
| D418,200 | S | 12/1999 | Ben-Tsur |
| 5,997,047 | A | 12/1999 | Pimentel et al. |
| 6,003,165 | A | 12/1999 | Loyd |
| D418,902 | S | 1/2000 | Haverstraw et al. |
| D418,903 | S | 1/2000 | Haverstraw et al. |
| D418,904 | S | 1/2000 | Milrud |

(56) References Cited

U.S. PATENT DOCUMENTS

| | | | |
|---|---|---|---|
| D421,099 | S | 2/2000 | Mullenmeister |
| 6,021,960 | A | 2/2000 | Kehat |
| D422,053 | S | 3/2000 | Brenner et al. |
| 6,042,027 | A | 3/2000 | Sandvik |
| 6,042,155 | A | 3/2000 | Lockwood |
| D422,336 | S | 4/2000 | Haverstraw et al. |
| D422,337 | S | 4/2000 | Chan |
| D423,083 | S | 4/2000 | Haug et al. |
| D423,110 | S | 4/2000 | Cipkowski |
| D424,160 | S | 5/2000 | Haug et al. |
| D424,161 | S | 5/2000 | Haug et al. |
| D424,162 | S | 5/2000 | Haug et al. |
| D424,163 | S | 5/2000 | Haug et al. |
| D426,290 | S | 6/2000 | Haug et al. |
| D427,661 | S | 7/2000 | Haverstraw et al. |
| D428,110 | S | 7/2000 | Haug et al. |
| D428,125 | S | 7/2000 | Chan |
| 6,085,780 | A | 7/2000 | Morris |
| D430,267 | S | 8/2000 | Milrud et al. |
| 6,095,801 | A | 8/2000 | Spiewak |
| D430,643 | S | 9/2000 | Tse |
| 6,113,002 | A | 9/2000 | Finkbeiner |
| 6,123,272 | A | 9/2000 | Havican et al. |
| 6,123,308 | A | 9/2000 | Faisst |
| D432,624 | S | 10/2000 | Chan |
| D432,625 | S | 10/2000 | Chan |
| D433,096 | S | 10/2000 | Tse |
| D433,097 | S | 10/2000 | Tse |
| 6,126,091 | A | 10/2000 | Heitzman |
| 6,126,290 | A | 10/2000 | Veigel |
| D434,109 | S | 11/2000 | Ko |
| 6,164,569 | A | 12/2000 | Hollinshead et al. |
| 6,164,570 | A | 12/2000 | Smeltzer |
| D435,889 | S | 1/2001 | Ben-Tsur et al. |
| D439,305 | S | 3/2001 | Slothower |
| 6,199,580 | B1 | 3/2001 | Morris |
| 6,202,679 | B1 | 3/2001 | Titus |
| D440,276 | S | 4/2001 | Slothower |
| D440,277 | S | 4/2001 | Slothower |
| D440,278 | S | 4/2001 | Slothower |
| D441,059 | S | 4/2001 | Fleischmann |
| 6,209,799 | B1 | 4/2001 | Finkbeiner |
| D443,025 | S | 5/2001 | Kollmann et al. |
| D443,026 | S | 5/2001 | Kollmann et al. |
| D443,027 | S | 5/2001 | Kollmann et al. |
| D443,029 | S | 5/2001 | Kollmann et al. |
| 6,223,998 | B1 | 5/2001 | Heitzman |
| 6,230,984 | B1 | 5/2001 | Jager |
| 6,230,988 | B1 | 5/2001 | Chao et al. |
| 6,230,989 | B1 | 5/2001 | Haverstraw et al. |
| D443,335 | S | 6/2001 | Andrus |
| D443,336 | S | 6/2001 | Kollmann et al. |
| D443,347 | S | 6/2001 | Gottwald |
| 6,241,166 | B1 | 6/2001 | Overington et al. |
| 6,250,572 | B1 | 6/2001 | Chen |
| D444,865 | S | 7/2001 | Gottwald |
| D445,871 | S | 7/2001 | Fan |
| 6,254,014 | B1 | 7/2001 | Clearman et al. |
| 6,270,278 | B1 | 8/2001 | Mauro |
| 6,276,004 | B1 | 8/2001 | Bertrand et al. |
| 6,283,447 | B1 | 9/2001 | Fleet |
| 6,286,764 | B1 | 9/2001 | Garvey et al. |
| D449,673 | S | 10/2001 | Kollmann et al. |
| D450,370 | S | 11/2001 | Wales et al. |
| D450,805 | S | 11/2001 | Lindholm et al. |
| D450,806 | S | 11/2001 | Lindholm et al. |
| D450,807 | S | 11/2001 | Lindholm et al. |
| D451,169 | S | 11/2001 | Lindholm et al. |
| D451,170 | S | 11/2001 | Lindholm et al. |
| D451,171 | S | 11/2001 | Lindholm et al. |
| D451,172 | S | 11/2001 | Lindholm et al. |
| 6,321,777 | B1 | 11/2001 | Wu |
| 6,322,006 | B1 | 11/2001 | Guo |
| D451,583 | S | 12/2001 | Lindholm et al. |
| D451,980 | S | 12/2001 | Lindholm et al. |
| D452,553 | S | 12/2001 | Lindholm et al. |
| D452,725 | S | 1/2002 | Lindholm et al. |
| D452,897 | S | 1/2002 | Gillette et al. |
| 6,336,764 | B1 | 1/2002 | Liu |
| D453,369 | S | 2/2002 | Lobermeier |
| D453,370 | S | 2/2002 | Lindholm et al. |
| D453,551 | S | 2/2002 | Lindholm et al. |
| 6,349,735 | B2 | 2/2002 | Gul |
| D454,617 | S | 3/2002 | Curbbun et al. |
| D454,938 | S | 3/2002 | Lord |
| 6,375,342 | B1 | 4/2002 | Koren et al. |
| D457,937 | S | 5/2002 | Lindholm et al. |
| 6,382,531 | B1 | 5/2002 | Tracy |
| D458,348 | S | 6/2002 | Mullenmeister |
| 6,412,711 | B1 | 7/2002 | Fan |
| D461,224 | S | 8/2002 | Lobermeier |
| D461,878 | S | 8/2002 | Green et al. |
| 6,450,425 | B1 | 9/2002 | Chen |
| 6,454,186 | B2 | 9/2002 | Haverstraw et al. |
| 6,463,658 | B1 | 10/2002 | Larsson |
| 6,464,265 | B1 | 10/2002 | Mikol |
| D465,552 | S | 11/2002 | Tse |
| D465,553 | S | 11/2002 | Singtoroj |
| 6,484,952 | B2 | 11/2002 | Koren |
| D468,800 | S | 1/2003 | Tse |
| D469,165 | S | 1/2003 | Lim |
| 6,502,796 | B1 | 1/2003 | Wales |
| 6,508,415 | B2 | 1/2003 | Wang |
| 6,511,001 | B1 | 1/2003 | Huang |
| D470,219 | S | 2/2003 | Schweitzer |
| 6,516,070 | B2 | 2/2003 | Macey |
| D471,253 | S | 3/2003 | Tse |
| D471,953 | S | 3/2003 | Colligan et al. |
| 6,533,194 | B2 | 3/2003 | Marsh et al. |
| 6,537,455 | B2 | 3/2003 | Farley |
| D472,958 | S | 4/2003 | Ouyoung |
| 6,550,697 | B2 | 4/2003 | Lai |
| 6,585,174 | B1 | 7/2003 | Huang |
| 6,595,439 | B1 | 7/2003 | Chen |
| 6,607,148 | B1 | 8/2003 | Marsh et al. |
| 6,611,971 | B1 | 9/2003 | Antoniello et al. |
| 6,637,676 | B2 | 10/2003 | Zieger et al. |
| 6,641,057 | B2 | 11/2003 | Thomas et al. |
| D483,837 | S | 12/2003 | Fan |
| 6,659,117 | B2 | 12/2003 | Gilmore |
| 6,659,372 | B2 | 12/2003 | Marsh et al. |
| D485,887 | S | 1/2004 | Luettgen et al. |
| D486,888 | S | 2/2004 | Lobermeier |
| 6,691,338 | B2 | 2/2004 | Zieger |
| 6,691,933 | B1 | 2/2004 | Bosio |
| D487,301 | S | 3/2004 | Haug et al. |
| D487,498 | S | 3/2004 | Blomstrom |
| 6,701,953 | B2 | 3/2004 | Agosta |
| 6,715,699 | B1 | 4/2004 | Greenberg et al. |
| 6,719,218 | B2 | 4/2004 | Cool et al. |
| D489,798 | S | 5/2004 | Hunt |
| D490,498 | S | 5/2004 | Golichowski |
| 6,736,336 | B2 | 5/2004 | Wong |
| 6,739,523 | B2 | 5/2004 | Haverstraw et al. |
| 6,739,527 | B1 | 5/2004 | Chung |
| D492,004 | S | 6/2004 | Haug et al. |
| D492,007 | S | 6/2004 | Kollmann et al. |
| 6,742,725 | B1 | 6/2004 | Fan |
| D493,208 | S | 7/2004 | Lin |
| D493,864 | S | 8/2004 | Haug et al. |
| D494,655 | S | 8/2004 | Lin |
| D494,661 | S | 8/2004 | Zieger et al. |
| D495,027 | S | 8/2004 | Mazzola |
| 6,776,357 | B1 | 8/2004 | Naito |
| 6,789,751 | B1 | 9/2004 | Fan |
| D496,987 | S | 10/2004 | Glunk |
| D497,974 | S | 11/2004 | Haug et al. |
| D498,514 | S | 11/2004 | Haug et al. |
| D500,121 | S | 12/2004 | Blomstrom |
| D500,549 | S | 1/2005 | Blomstrom |
| D501,242 | S | 1/2005 | Blomstrom |
| D502,760 | S | 3/2005 | Zieger et al. |
| D502,761 | S | 3/2005 | Zieger et al. |
| D503,211 | S | 3/2005 | Lin |

(56) References Cited

U.S. PATENT DOCUMENTS

| | | | | |
|---|---|---|---|---|
| 6,863,227 | B2 | 3/2005 | Wollenberg et al. | |
| 6,869,030 | B2 | 3/2005 | Blessing et al. | |
| D503,774 | S | 4/2005 | Zieger | |
| D503,775 | S | 4/2005 | Zieger | |
| D503,966 | S | 4/2005 | Zieger | |
| 6,899,292 | B2 | 5/2005 | Titinet | |
| D506,243 | S | 6/2005 | Wu | |
| D507,037 | S | 7/2005 | Wu | |
| 6,935,581 | B2 | 8/2005 | Titinet | |
| D509,280 | S | 9/2005 | Bailey et al. | |
| D509,563 | S | 9/2005 | Bailey et al. | |
| D510,123 | S | 9/2005 | Tsai | |
| D511,809 | S | 11/2005 | Haug et al. | |
| D512,119 | S | 11/2005 | Haug et al. | |
| 6,981,661 | B1 * | 1/2006 | Chen | 239/532 |
| D516,169 | S | 2/2006 | Wu | |
| 7,000,854 | B2 | 2/2006 | Malek et al. | |
| 7,004,409 | B2 | 2/2006 | Okubo | |
| 7,004,410 | B2 | 2/2006 | Li | |
| D520,109 | S | 5/2006 | Wu | |
| 7,040,554 | B2 | 5/2006 | Drennow | |
| 7,048,210 | B2 | 5/2006 | Clark | |
| 7,055,767 | B1 | 6/2006 | Ko | |
| 7,070,125 | B2 | 7/2006 | Williams et al. | |
| 7,077,342 | B2 | 7/2006 | Lee | |
| D527,440 | S | 8/2006 | Macan | |
| 7,093,780 | B1 | 8/2006 | Chung | |
| 7,097,122 | B1 | 8/2006 | Farley | |
| D528,631 | S | 9/2006 | Gillette et al. | |
| 7,100,845 | B1 | 9/2006 | Hsieh | |
| 7,111,795 | B2 | 9/2006 | Thong | |
| 7,111,798 | B2 | 9/2006 | Thomas et al. | |
| D530,389 | S | 10/2006 | Genslak et al. | |
| D530,392 | S | 10/2006 | Tse | |
| D531,259 | S | 10/2006 | Hsieh | |
| 7,114,666 | B2 | 10/2006 | Luettgen et al. | |
| D533,253 | S | 12/2006 | Luettgen et al. | |
| D534,239 | S | 12/2006 | Dingler et al. | |
| D535,354 | S | 1/2007 | Wu | |
| D536,060 | S | 1/2007 | Sadler | |
| 7,156,325 | B1 * | 1/2007 | Chen | 239/532 |
| D538,391 | S | 3/2007 | Mazzola | |
| D540,424 | S | 4/2007 | Kirar | |
| D540,425 | S | 4/2007 | Endo et al. | |
| D540,426 | S | 4/2007 | Cropelli | |
| D540,427 | S | 4/2007 | Bouroullec et al. | |
| D542,391 | S | 5/2007 | Gilbert | |
| D542,393 | S | 5/2007 | Haug et al. | |
| 7,229,031 | B2 | 6/2007 | Schmidt | |
| 7,243,863 | B2 | 7/2007 | Glunk | |
| 7,246,760 | B2 | 7/2007 | Marty et al. | |
| D552,713 | S | 10/2007 | Rexach | |
| 7,278,591 | B2 | 10/2007 | Clearman et al. | |
| D556,295 | S | 11/2007 | Genord et al. | |
| 7,299,510 | B2 | 11/2007 | Tsai | |
| D557,763 | S | 12/2007 | Schonherr et al. | |
| D557,764 | S | 12/2007 | Schonherr et al. | |
| D557,765 | S | 12/2007 | Schonherr et al. | |
| D558,301 | S | 12/2007 | Hoernig | |
| 7,303,151 | B2 | 12/2007 | Wu | |
| D559,357 | S | 1/2008 | Wang et al. | |
| D559,945 | S | 1/2008 | Patterson et al. | |
| D560,269 | S | 1/2008 | Tse | |
| D562,937 | S | 2/2008 | Schonherr et al. | |
| D562,938 | S | 2/2008 | Blessing | |
| D562,941 | S | 2/2008 | Pan | |
| 7,331,536 | B1 | 2/2008 | Zhen et al. | |
| 7,347,388 | B2 | 3/2008 | Chung | |
| D565,699 | S | 4/2008 | Berberet | |
| D565,702 | S | 4/2008 | Daunter et al. | |
| D565,703 | S | 4/2008 | Lammel et al. | |
| D566,228 | S | 4/2008 | Neagoe | |
| D566,229 | S | 4/2008 | Rexach | |
| D567,328 | S | 4/2008 | Spangler et al. | |
| 7,360,723 | B2 | 4/2008 | Lev | |
| 7,364,097 | B2 | 4/2008 | Okuma | |
| 7,374,112 | B1 | 5/2008 | Bulan et al. | |
| 7,384,007 | B2 | 6/2008 | Ho | |
| D577,099 | S | 9/2008 | Leber | |
| D577,793 | S | 9/2008 | Leber | |
| D580,012 | S | 11/2008 | Quinn et al. | |
| D580,513 | S | 11/2008 | Quinn et al. | |
| D581,013 | S | 11/2008 | Citterio | |
| D581,014 | S | 11/2008 | Quinn et al. | |
| 7,503,345 | B2 | 3/2009 | Paterson et al. | |
| D590,048 | S | 4/2009 | Leber et al. | |
| 7,520,448 | B2 | 4/2009 | Luettgen et al. | |
| D592,276 | S | 5/2009 | Schoenherr et al. | |
| D592,278 | S | 5/2009 | Leber | |
| 7,537,175 | B2 | 5/2009 | Miura et al. | |
| D600,777 | S | 9/2009 | Whitaker et al. | |
| D603,935 | S | 11/2009 | Leber | |
| 7,617,990 | B2 | 11/2009 | Huffman | |
| D605,731 | S | 12/2009 | Leber | |
| D606,623 | S | 12/2009 | Whitaker et al. | |
| D608,412 | S | 1/2010 | Barnard et al. | |
| D608,413 | S | 1/2010 | Barnard et al. | |
| D616,061 | S | 5/2010 | Whitaker et al. | |
| 7,721,979 | B2 | 5/2010 | Mazzola | |
| 7,740,186 | B2 | 6/2010 | Macan et al. | |
| D621,904 | S | 8/2010 | Yoo et al. | |
| D621,905 | S | 8/2010 | Yoo et al. | |
| 7,770,820 | B2 | 8/2010 | Clearman et al. | |
| 7,770,822 | B2 | 8/2010 | Leber | |
| D624,156 | S | 9/2010 | Leber | |
| 7,789,326 | B2 | 9/2010 | Luettgen et al. | |
| D625,776 | S | 10/2010 | Williams | |
| 7,832,662 | B2 | 11/2010 | Gallo | |
| D628,676 | S | 12/2010 | Lee | |
| D629,867 | S | 12/2010 | Rexach et al. | |
| D641,831 | S | 7/2011 | Williams | |
| 8,020,787 | B2 | 9/2011 | Leber | |
| 8,020,788 | B2 | 9/2011 | Luettgen et al. | |
| 8,028,935 | B2 | 10/2011 | Leber | |
| 8,109,450 | B2 | 2/2012 | Luettgen et al. | |
| 8,132,745 | B2 | 3/2012 | Leber et al. | |
| 8,146,838 | B2 | 4/2012 | Luettgen et al. | |
| 2002/0109023 | A1 * | 8/2002 | Thomas et al. | 239/562 |
| 2003/0062426 | A1 | 4/2003 | Gregory et al. | |
| 2003/0121993 | A1 | 7/2003 | Haverstraw et al. | |
| 2004/0074993 | A1 * | 4/2004 | Thomas et al. | 239/525 |
| 2004/0118949 | A1 | 6/2004 | Marks | |
| 2004/0217209 | A1 * | 11/2004 | Bui | 239/548 |
| 2004/0244105 | A1 | 12/2004 | Tsai | |
| 2005/0001072 | A1 | 1/2005 | Bolus et al. | |
| 2005/0283904 | A1 | 12/2005 | Macan et al. | |
| 2005/0284967 | A1 | 12/2005 | Korb | |
| 2006/0016908 | A1 | 1/2006 | Chung | |
| 2006/0016913 | A1 * | 1/2006 | Lo | 239/532 |
| 2006/0102747 | A1 | 5/2006 | Ho | |
| 2006/0163391 | A1 | 7/2006 | Schorn | |
| 2006/0219822 | A1 | 10/2006 | Miller et al. | |
| 2007/0040054 | A1 | 2/2007 | Farzan | |
| 2007/0119980 | A1 | 5/2007 | Somerfield et al. | |
| 2007/0200013 | A1 | 8/2007 | Hsiao | |
| 2007/0246577 | A1 | 10/2007 | Leber | |
| 2007/0252021 | A1 | 11/2007 | Cristina | |
| 2007/0272770 | A1 | 11/2007 | Leber et al. | |
| 2008/0073449 | A1 | 3/2008 | Haynes et al. | |
| 2008/0083844 | A1 | 4/2008 | Leber et al. | |
| 2008/0121293 | A1 | 5/2008 | Leber et al. | |
| 2008/0156897 | A1 | 7/2008 | Leber | |
| 2008/0223957 | A1 | 9/2008 | Schorn | |
| 2008/0272591 | A1 | 11/2008 | Leber | |
| 2009/0200404 | A1 | 8/2009 | Cristina | |
| 2009/0218420 | A1 | 9/2009 | Mazzola | |
| 2009/0307836 | A1 | 12/2009 | Blattner et al. | |
| 2010/0065665 | A1 | 3/2010 | Whitaker | |

FOREIGN PATENT DOCUMENTS

| | | |
|---|---|---|
| CH | 234284 | 3/1963 |
| DE | 352813 | 5/1922 |
| DE | 848627 | 9/1952 |

(56) References Cited

FOREIGN PATENT DOCUMENTS

| | | |
|---|---|---|
| DE | 854100 | 10/1952 |
| DE | 2360534 | 6/1974 |
| DE | 2806093 | 8/1979 |
| DE | 3107808 | 9/1982 |
| DE | 3246327 | 6/1984 |
| DE | 3440901 | 7/1985 |
| DE | 3706320 | 3/1988 |
| DE | 8804236 | 6/1988 |
| DE | 4034695 | 5/1991 |
| DE | 19608085 | 9/1996 |
| DE | 202005000881 | 3/2005 |
| DE | 102006032017 | 1/2008 |
| EP | 0167063 | 6/1985 |
| EP | 0478999 | 4/1992 |
| EP | 0514753 | 11/1992 |
| EP | 0435030 | 7/1993 |
| EP | 0617644 | 10/1994 |
| EP | 0683354 | 11/1995 |
| EP | 0687851 | 12/1995 |
| EP | 0695907 | 2/1996 |
| EP | 0700729 | 3/1996 |
| EP | 0719588 | 7/1996 |
| EP | 0721082 | 7/1996 |
| EP | 0733747 | 9/1996 |
| EP | 0808661 | 11/1997 |
| EP | 0726811 | 1/1998 |
| EP | 2164642 | 10/2010 |
| EP | 2260945 | 12/2010 |
| FR | 538538 | 6/1922 |
| FR | 873808 | 7/1942 |
| FR | 1039750 | 10/1953 |
| FR | 1098836 | 8/1955 |
| FR | 2596492 | 10/1987 |
| FR | 2695452 | 3/1994 |
| GB | 3314 | 0/1914 |
| GB | 10086 | 0/1894 |
| GB | 129812 | 7/1919 |
| GB | 204600 | 10/1923 |
| GB | 634483 | 3/1950 |
| GB | 971866 | 10/1964 |
| GB | 1111126 | 4/1968 |
| GB | 2066074 | 1/1980 |
| GB | 2066704 | 7/1981 |
| GB | 2068778 | 8/1981 |
| GB | 2121319 | 12/1983 |
| GB | 2155984 | 10/1985 |
| GB | 2156932 A | 10/1985 |
| GB | 2199771 | 7/1988 |
| GB | 2298595 | 11/1996 |
| GB | 2337471 | 11/1999 |
| IT | 327400 | 7/1935 |
| IT | 350359 | 7/1937 |
| IT | 563459 | 5/1957 |
| JP | S63-181459 | 11/1988 |
| JP | H2-78660 | 6/1990 |
| JP | 4062238 | 2/1992 |
| JP | 4146708 | 5/1992 |
| NL | 8902957 | 6/1991 |
| WO | WO93/12894 | 7/1993 |
| WO | WO93/25839 | 12/1993 |
| WO | WO96/00617 | 1/1996 |
| WO | WO98/30336 | 7/1998 |
| WO | WO99/59726 | 11/1999 |
| WO | WO00/10720 | 3/2000 |
| WO | WO2010/004593 | 1/2010 |

OTHER PUBLICATIONS

Labeled 1A, Gemlo, available at least as early as Dec. 2, 1998.
Labeled 1B, Gemlo, available at least as early as Dec. 2, 1998.

* cited by examiner

HANDHELD SHOWERHEAD WITH FLUID PASSAGEWAYS

CROSS-REFERENCE TO RELATED APPLICATIONS

This application is a continuation of U.S. patent application Ser. No. 12/870,032 filed on 27 Aug. 2010 and entitled "Handheld Showerhead with Mode Control in Handle," which is a continuation of U.S. patent application Ser. No. 11/669,132 filed on 30 Jan. 2007 and entitled, "Handheld Showerhead with Mode Control and Method of Selecting a Handheld Showerhead Mode," which claimed the benefit of priority pursuant to 35 U.S.C. §119(e) of U.S. Provisional Application No. 60/882,898 filed 29 Dec. 2006 entitled "Handheld Showerhead with Mode Control," each of which is hereby incorporated by reference herein in its entirety.

INCORPORATION BY REFERENCE

This application is related to U.S. Provisional Application No. 60/867,778, entitled "Showerhead System" and filed on Nov. 29, 2006, which is hereby incorporated by reference herein in its entirety.

FIELD

The present invention generally relates to showerheads, and more particularly to handheld showerheads.

BACKGROUND

Handheld showerheads typically have showerhead and handle portions. The showerhead portion includes a showerhead face with nozzles and openings for delivering water to a user from the handheld showerhead. The handle portion provides a structure for a user to hold when using the handheld showerhead.

Handheld showerheads may include more than one mode of operation. Multiple modes of operation provide a user with flexibility to select a desired spray pattern, or pause water flow from the handheld showerhead. Some possible spray patterns for a handheld showerhead with multiple modes of operation may include standard water streams, converging water streams, pulsating water streams, and mist sprays. For a handheld showerhead with multiple modes of operation, a circular ring is formed to rotate around the showerhead face. A user rotates the circular ring around the showerhead face until the desired mode of operation is selected.

SUMMARY

To rotate a mode or feature control ring around a showerhead face, the showerhead must have a round face, thus limiting the options for designing an aesthetically appealing showerhead. Further, the face ring's location causes the user to place a hand in the shower flow, thus directing the shower flow potentially in multiple directions undesired directions. Yet further, two hands are often needed to rotate a face ring around the showerhead in order to change the showerhead mode.

One embodiment may take the form of a handheld showerhead. The handheld showerhead may include a showerhead portion including a plurality of nozzles and at least two fluid channels in fluid communication with respective subsets of the plurality of nozzles. The at least two fluid channels are defined in part by at least two walls that are adjacent and parallel to each other and a curved wall that extends between edges of the at least two walls. The showerhead further includes a base wall defining two or more fluid channel inlets each in fluid communication with a respective one of the two more fluid channels, a handle portion operatively associated with the showerhead portion, including at least one of a fluid inlet and a fluid passage, and a rotatable mode selector. Movement of the mode selector selectively places the fluid inlet or the fluid passage of the handle portion in fluid communication with one of the at least two fluid channels via a respective one of the fluid channel inlets.

Another embodiment may take the form of a handheld showerhead. The showerhead includes a showerhead portion and a handle portion operatively associated with the showerhead portion. The showerhead portion includes at least two fluid channels, wherein the at least two fluid channels are defined in part by at least two walls that are adjacent and parallel to each other and a curved wall that extends between the edges of the at least two walls and a base wall formed at a first end of each of the at least two fluid channels and defining two or more fluid inlets each in fluid communication with a respective one of the two or more fluid channels. The handle portion includes a fluid passage and a rotatable mode selector. The showerhead portion is positioned relative to the handle portion such that a fluid exiting the showerhead portion under operational flow conditions initially moves primarily in a direction that forms a right angle or an acute angle with respect to a longitudinal axis of the handle portion and rotation of the mode selector selectively places the fluid inlet or the fluid passage in fluid communication with one of at least two fluid channels.

DETAILED DESCRIPTION

Described herein are various embodiments of handheld showerheads with mode selectors. The handheld showerheads may include showerheads with two or more groups of nozzles and/or openings. Each group of nozzles and/or openings may provide a unique spray mode, such as a mist spray, a pulsating stream, converging streams, and so on. A handle portion connected to a showerhead portion may collectively define a body of the showerhead. A user may grasp the handle portion to change the position of the showerhead relative to the user. The handle portion may include a water supply connector and a mode selector movable relative to the handle portion for selecting a showerhead spray mode. The mode selector may take the form of a control knob or lever, and may be positioned anywhere along the handle portion. A user may selectively rotate or slide the control knob relative to the handle portion to change the showerhead's spray mode.

Figure 1:
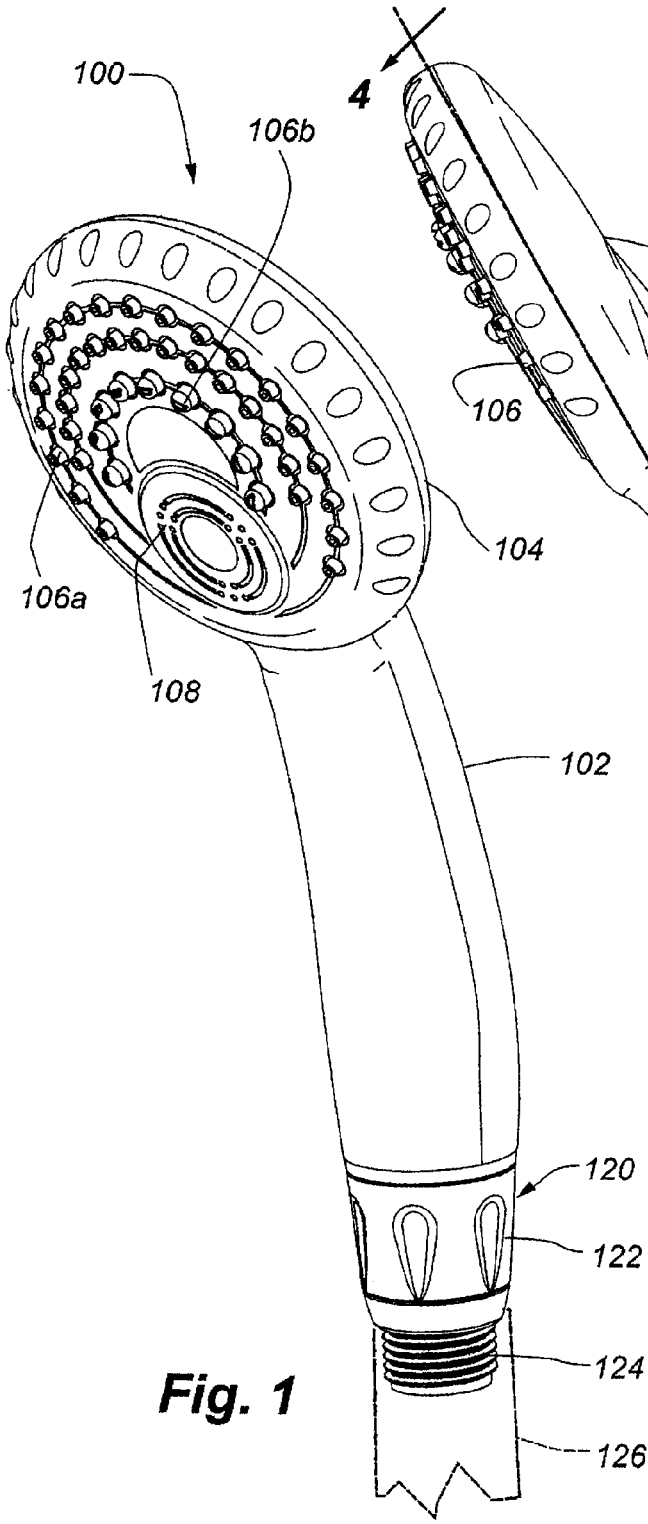
FIG. 1 is a front perspective view of a first embodiment of a handheld showerhead.
Figure 2:
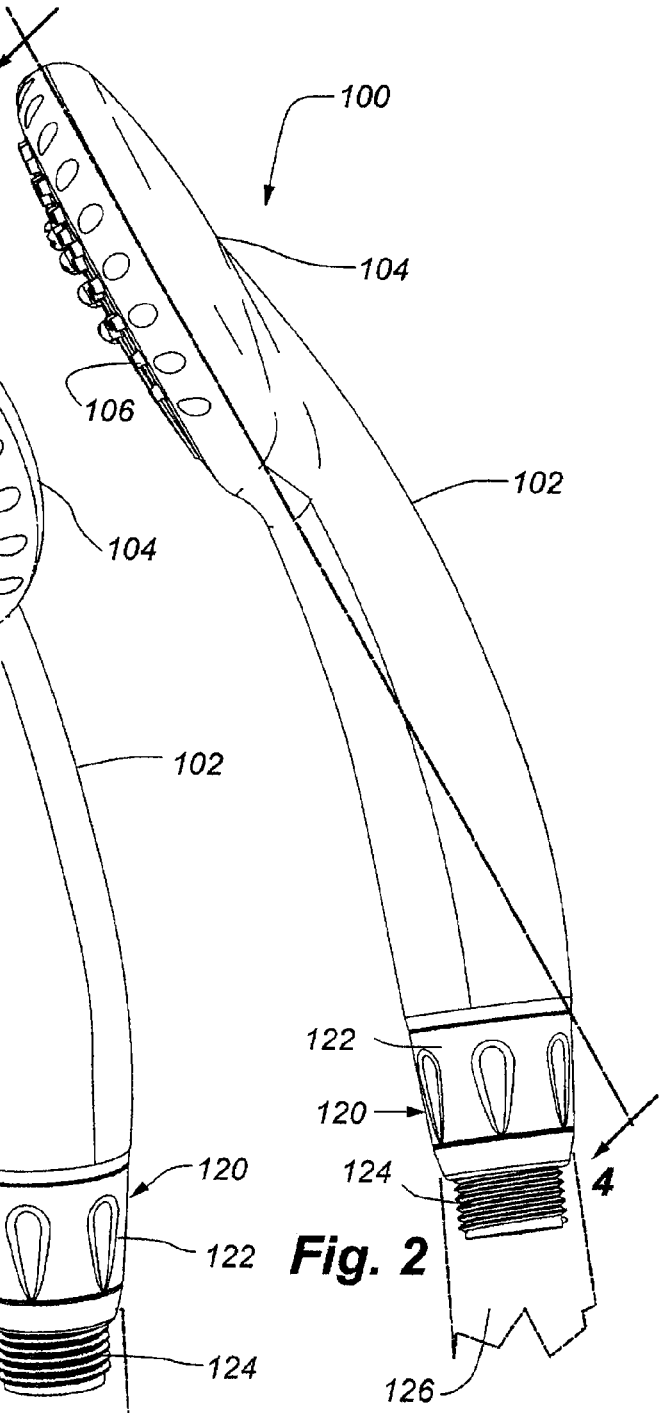
FIG. 2 is a side perspective view of the handheld showerhead shown in FIG. 1.

FIGS. 1-10 depict one embodiment of a handheld showerhead with a mode selector. With reference to FIGS. 1 and 2, the handheld showerhead 100 may include a handle portion 102 joined to a showerhead portion 104. The handheld showerhead 100 may include multiple spray modes. Water for each spray mode may be delivered from the handheld showerhead 100 through nozzles 106, openings 108, or both, defined in the showerhead portion 104. The handheld showerhead 100 depicted in FIGS. 1 and 2, includes three spray modes. Other embodiments of the handheld showerhead may include more or less than three spray modes.

In the embodiment depicted in FIGS. 1 and 2, the showerhead portion 104 has two groups of nozzles 106*a-b*. Each group of nozzles 106*a-b* corresponds to a showerhead spray mode. Accordingly, the two groups of nozzles 106*a-b* provide for two showerhead spray modes. The showerhead portion 104 also includes multiple pulsating openings 108 for delivering yet another showerhead spray mode, a pulsating water spray, to a user. Each group of nozzles 106 and openings 108 may be formed from a single nozzle or opening, or from more than one nozzle and opening.

If desired, more or less than two nozzle groups may provide more or less than two spray modes. Similarly, more or less groups of pulsating openings may provide more or less than one pulsating spray mode. Further, nozzles 106 may be substituted for the pulsating openings 108 to deliver pulsating spray modes from the showerhead portion 104, and openings 108 may be substituted for the nozzles 106 to deliver non-pulsating spray modes. Yet further, any spray mode, pulsating or non-pulsating, may be delivered from the showerhead portion 104 by a combination of nozzles 106 and openings 108. The nozzles 106 and openings 108 may be configured to deliver converging or non-converging water streams, mist sprays, or any other spray from the showerhead portion 104.

With continued reference to FIGS. 1 and 2, a user may select a showerhead spray mode using a mode selector 120 as described in more detail below. The mode selector 120 may include as a control knob 122 movably joined to the handle portion 102 near the handle's bottom end portion. More particularly, a user may selectively rotate, turn, slide or otherwise move the control knob 122 relative to the handle portion 104. Such selective movement changes which group of nozzles 106*a-b* or openings 108 receive water from a water supply connector 124 in fluid communication with a water or other fluid supply, and thus changes the showerhead spray mode. For the handheld showerhead 100 depicted in FIGS. 1 and 2, a user moves the control knob 122 relative to the handle portion 102 by rotating the control knob 122 about the handle portion's longitudinal axis. In other embodiments, however, a user may move the control knob 122 relative to the handle portion 102 by other methods, such as sliding it relative to the handle portion 102.

Still referring the FIGS. 1 and 2, the water supply connector 124 may be externally threaded along a lower portion for threadedly joining the handheld showerhead 100 to a shower hose 126, tube or the like. The shower hose 126, in turn, may be in fluid communication with a shower pipe (not shown), which in turn may be in fluid communication with a water supply source (also not shown) or other fluid structure. Thus, water may flow from the fluid supply source to the handheld showerhead 100 via the shower pipe and the shower hose 126.

Figure 3:
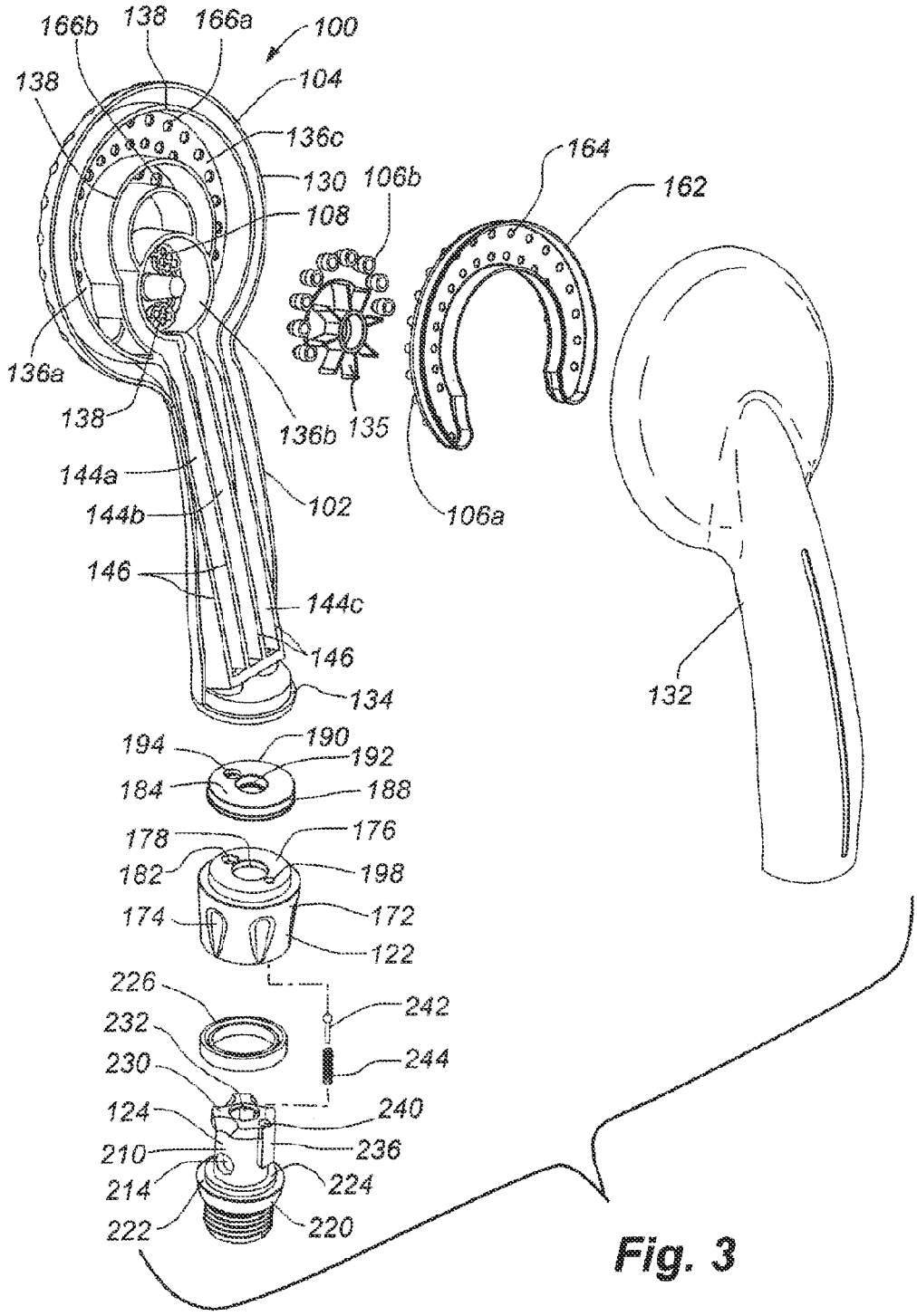
FIG. 3 is an exploded rear perspective view of the handheld showerhead shown in FIG. 1.
Figure 3A:
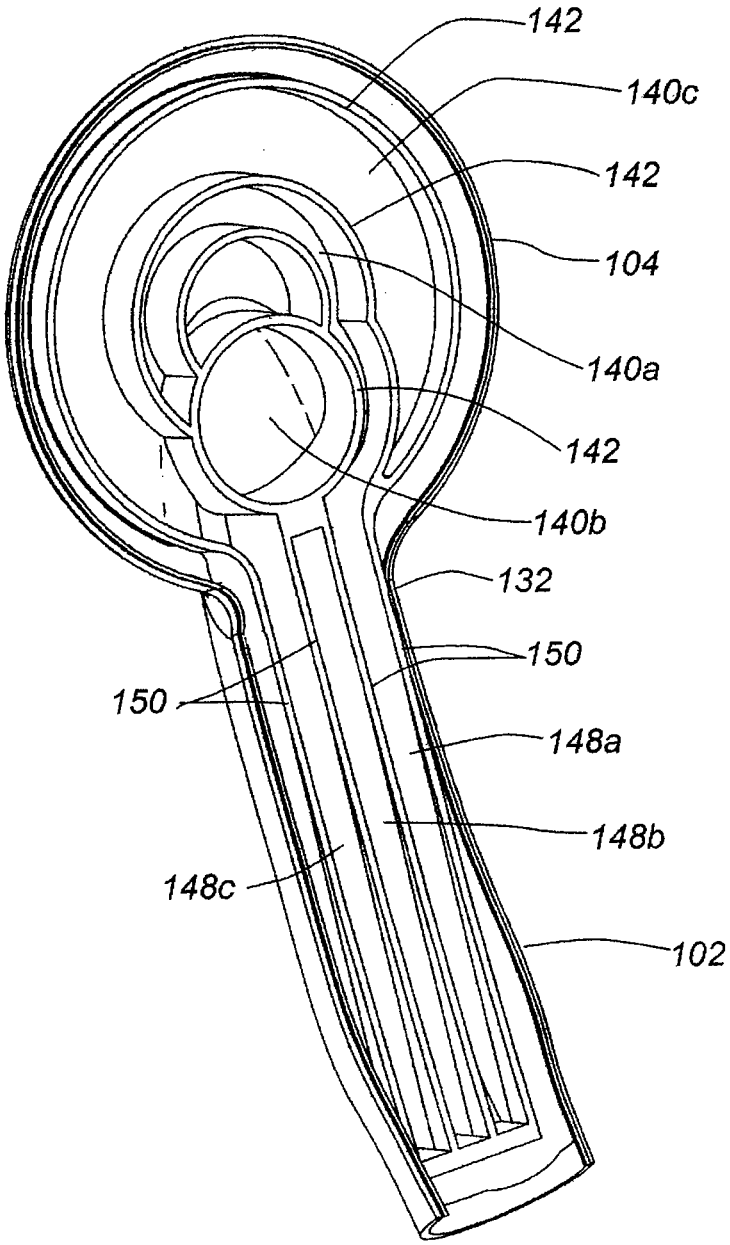
FIG. 3A is a front perspective view of the rear body segment of the handheld showerhead shown in FIG. 1.
Figure 4:
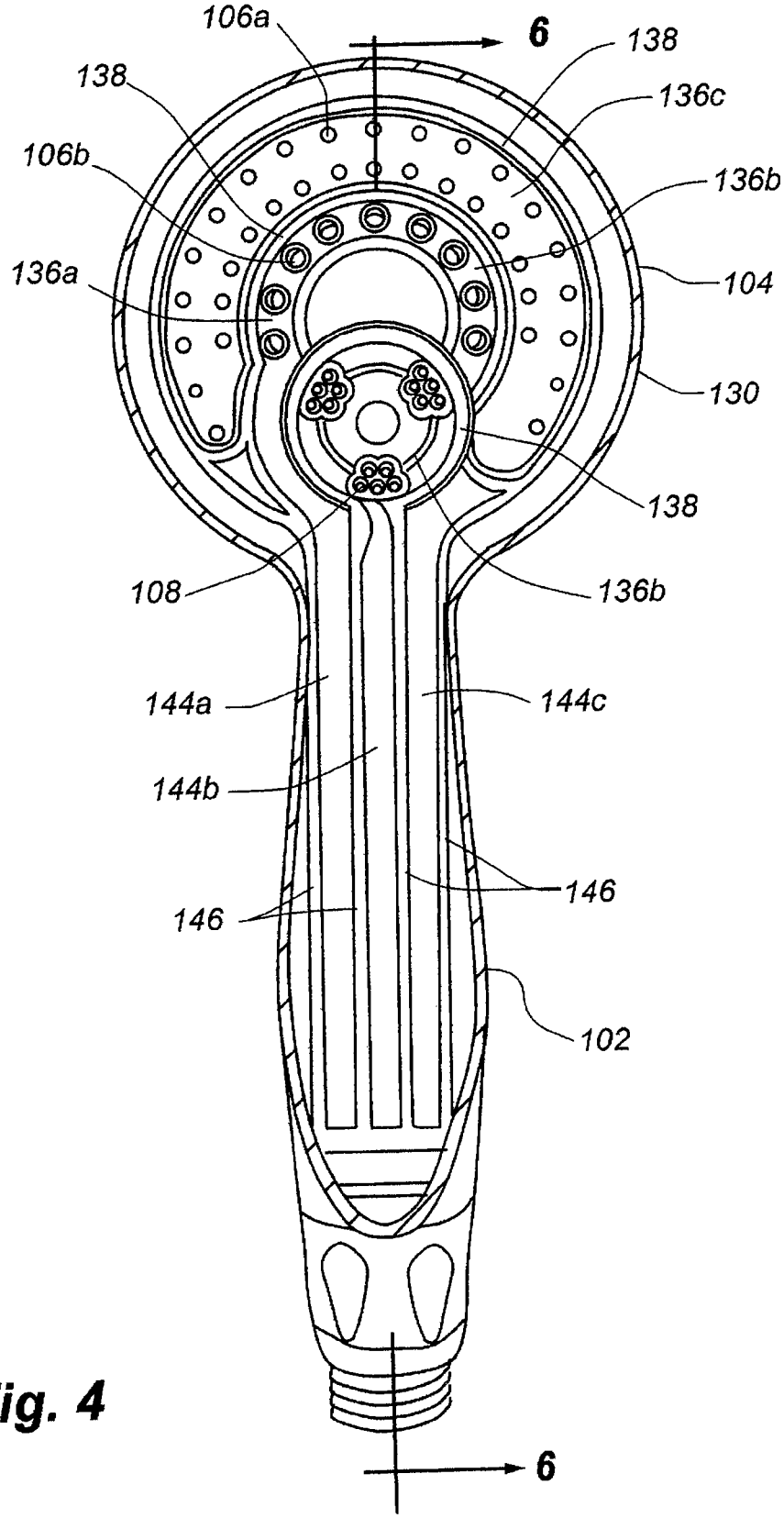
FIG. 4 is a rear view of the handheld showerhead with an upper portion removed to show the interior of the handheld showerhead.

Turning to FIGS. 3, 3A, and 4, the showerhead portion 104 and handle portion 102 may be formed from front and rear showerhead handle portions 130, 132. The front showerhead handle portion 130 may include the front portions of the showerhead portion 104 and the handle portion 102 and a handle base 134, and the rear showerhead handle portion 132 may include the rear portions of the showerhead portion 104 and the handle portion 102. In some embodiments, the showerhead portion 104 and the handle portion 102 may be formed from a single element, or may be formed from more than two elements. Further, the showerhead and handle portions 104, 102 may be formed from left and right showerhead handle portions, and so on.

For a handheld showerhead 100 with three spray modes, the showerhead portion 104 of the front showerhead handle portion 130 may be divided into three front fluid chambers 136*a-c* by front showerhead sidewalls 138 extending rearwardly from the front face of the showerhead portion 104. Each front fluid chamber 136*a-c* fluidly communicates with one of the three groups of nozzles 106 or openings 108 and may include a turbine 135 or other device to provide pulsating, rotating, or other various streams, flows, or sprays. For example, the outer front fluid chamber 136*c* fluidly communicates with the first group of nozzles 106*a*. Although each group of nozzles 106*a-b* and openings 108 is shown and described as being in fluid communication with one front fluid chamber 136*a-c*, any group of nozzles 106 or openings 108 may be in fluid communication with two or more front fluid chambers 136. Similarly, one or more front fluid chambers 136*a-c* may be used to provide fluid communication to each group of nozzles 106 or openings 108 associated with a spray mode.

In a manner similar to the front showerhead handle member 130, and as best shown in FIG. 3A, the showerhead portion 104 of the rear showerhead handle member 132 may be divided into three rear fluid chambers 140*a-c* by rear showerhead sidewalls 142. Each rear fluid chamber 140*a-c* matches a corresponding front fluid chamber 136*a-c*. Accordingly, when the front and rear showerhead handle members 130, 132 are joined, each matching front and rear fluid chamber 136*a-c*, 140*a-c* defines a showerhead fluid chamber in fluid communication with one of three groups of nozzles 106 or openings 108. To limit fluid leakage from these chambers, the front and rear showerhead sidewalls 138, 142 may be heat welded, sonic welded, or otherwise joined in a manner that forms a water-tight seal along their connected edges. Generally, the number of fluid chambers within the showerhead equals the number of groups of nozzles 106 or openings 108. However, in some embodiments, the total number of fluid chambers may be greater than the number nozzle or opening groups, such as when two distinct fluid chambers are in fluid communication with one group of nozzles 106 or openings 108.

Figure 5:
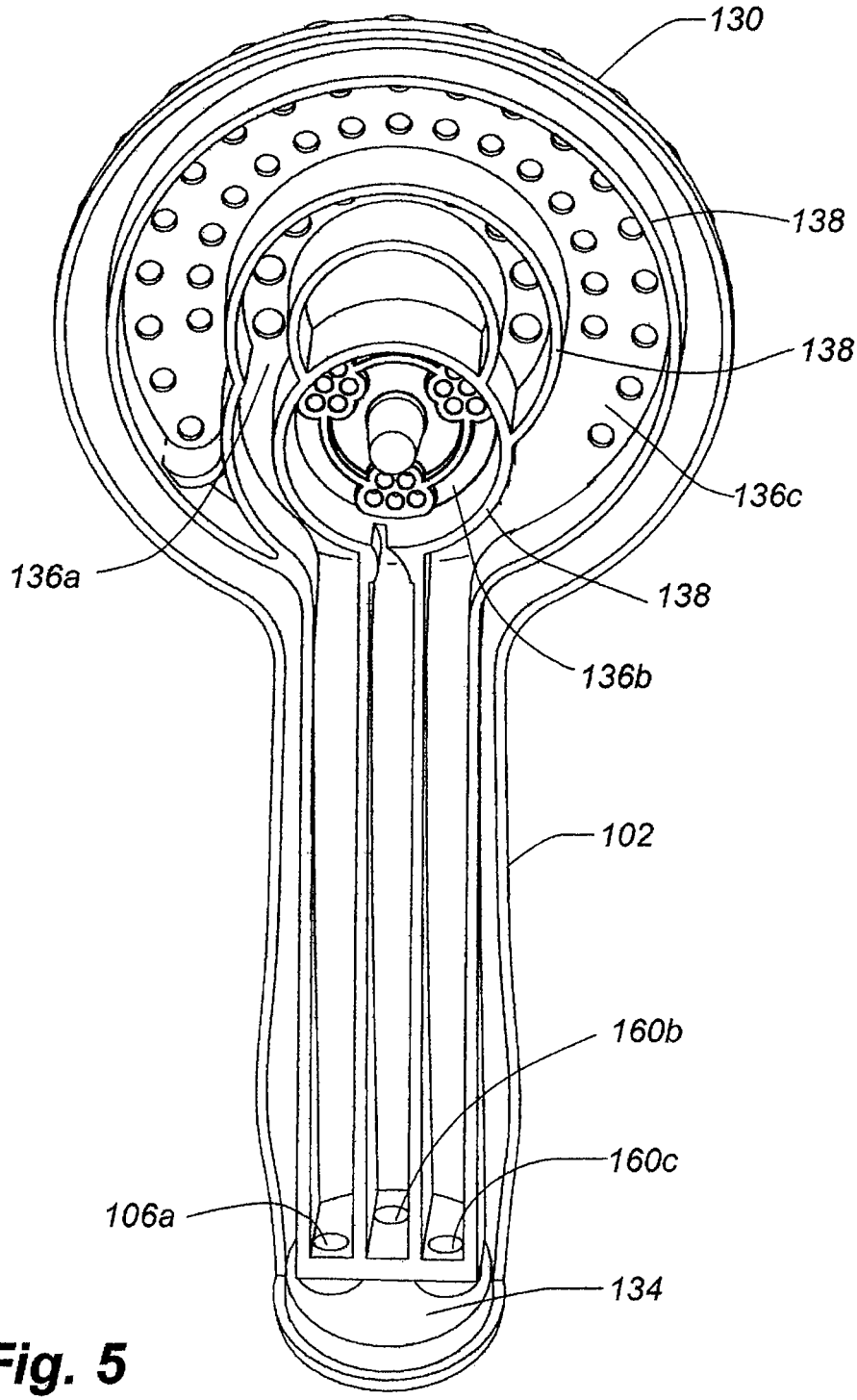
FIG. 5 is a rear perspective view of the front body segment for the handheld showerhead depicted in FIG. 1.

With continued reference to FIGS. 3, 4, and 5, the front showerhead handle portion 130 may include three U-shaped front channels 144*a-c*, or other suitably shaped fluid, formed by front channel sidewalls 146 extending rearwardly from the inner surface of the front side of the front showerhead handle portion 130. The three front channels 144*a-c* may extend from the handle base 134 to the showerhead portion 104. Each front channel 140*a-c* fluidly communicates with one of the three fluid chambers. In some embodiments, two or more front channels 144*a-c* may fluidly communicate with a fluid chamber, thus providing two or more pathways for fluid to flow from the handle base 134 to a fluid chamber in the showerhead 104.

Figure 9:
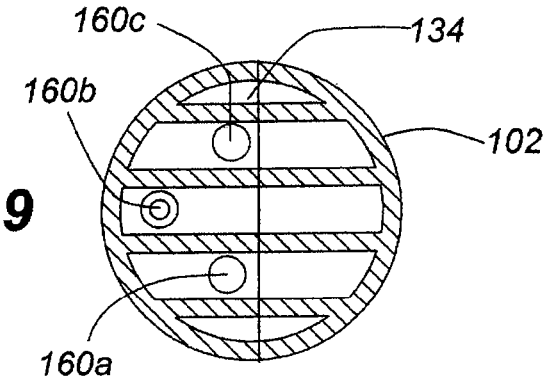
FIG. 9 is a cross-sectional view of the handheld showerhead illustrated in FIG. 1, taken along line 9-9 in FIG. 6.
Figure 8:
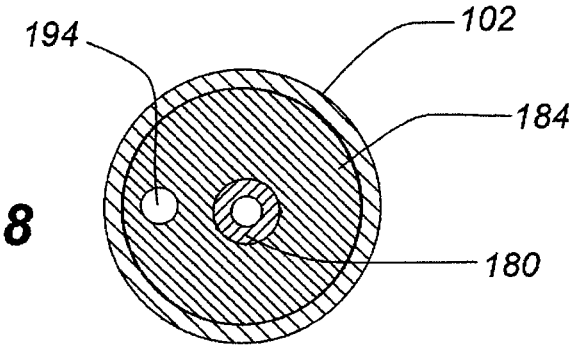
FIG. 8 is a cross-sectional view of the handheld showerhead illustrated in FIG. 1, taken along line 8-8 in FIG. 6.

Similarly, as best shown in FIG. 3A, the rear showerhead handle portion 132 may include three U-shaped rear channels 148*a-c*, or other suitably shaped fluid channels, formed by rear channel sidewalls 150 extending forwardly from the inner surface of the rear side of the rear showerhead handle member 132. Each rear fluid channel 148*a-c* corresponds to a front fluid channel 144*a-c*. Accordingly, when the front and rear showerhead handle members 130, 132 are joined, each front and rear channel 144*a-c*, 148*a-c* defines a fluid channel. When the two halves 130, 132 of the handle portion 102 of the body are fixed together, the sidewalls 146, 148 may be seen as chords across the circular form of the handle portion 102 of the body, when viewed in cross section as in FIG. 9, forming fluid channels extending within the handle 102. FIG. 9 shows the circular body of the handle 102 and the sidewalls 146, 150 extending parallel that connect displaced positions on the circular body. The fluid channels are thus bounded by parallel chords (i.e., the sidewalls 146, 150) and arcs of the body wall in the handle portion 102 defined between endpoints of adjacent parallel chords.

Each fluid channel is separate from the other fluid channels (i.e., not in fluid communication with the other fluid channels) and is in fluid communication with one of the three fluid chambers formed in the showerhead portion 104. In some embodiments, two or more rear channels 148*a-c* may combine with two or more front channels 144*a-c* to define two or more fluid channels in fluid communication with a fluid chamber, thus providing two or more fluid channels for fluid to flow from the handle base 134 to a fluid chamber in the showerhead 104. Alternatively or conjunctively, tubes or other fluid conveyance structures may be positioned or defined within the handle or showerhead portions 102, 104 to provide fluid communication between the showerhead fluid chambers and handle base 134.

Figure 10:
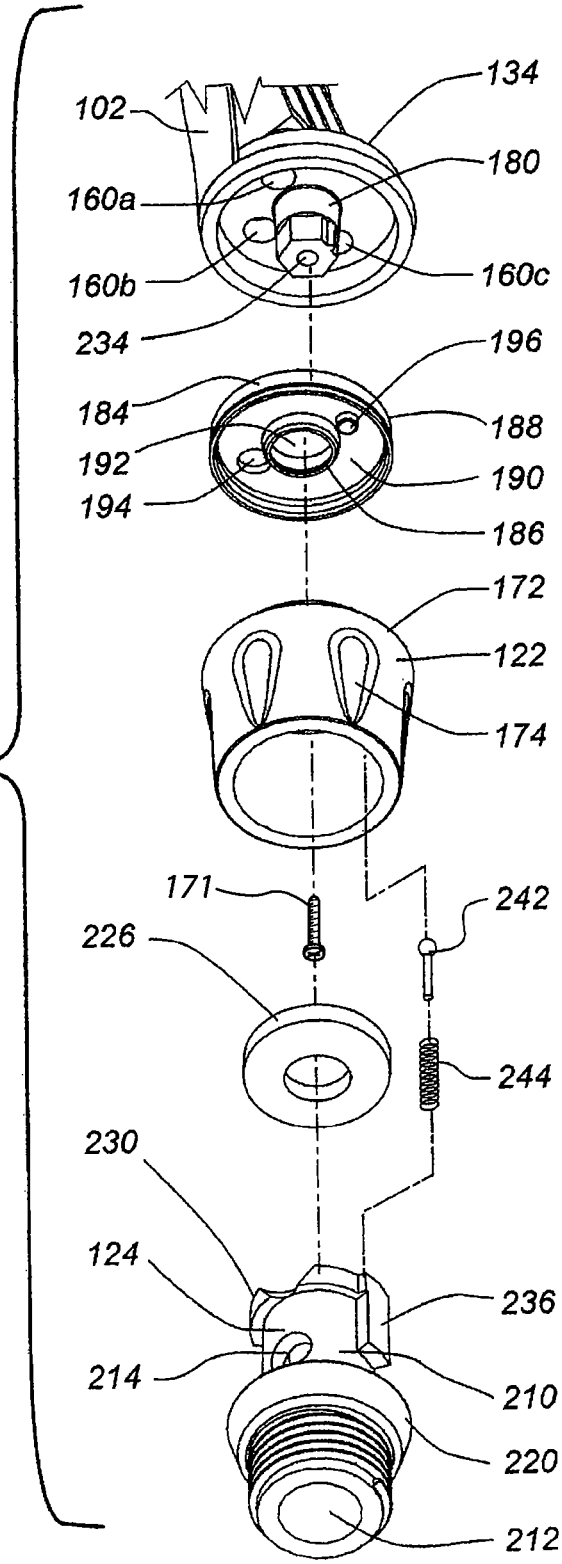
FIG. 10 is a partial exploded perspective view of elements forming a lower portion of the handheld showerhead illustrated in FIG. 1.
Figure 11:
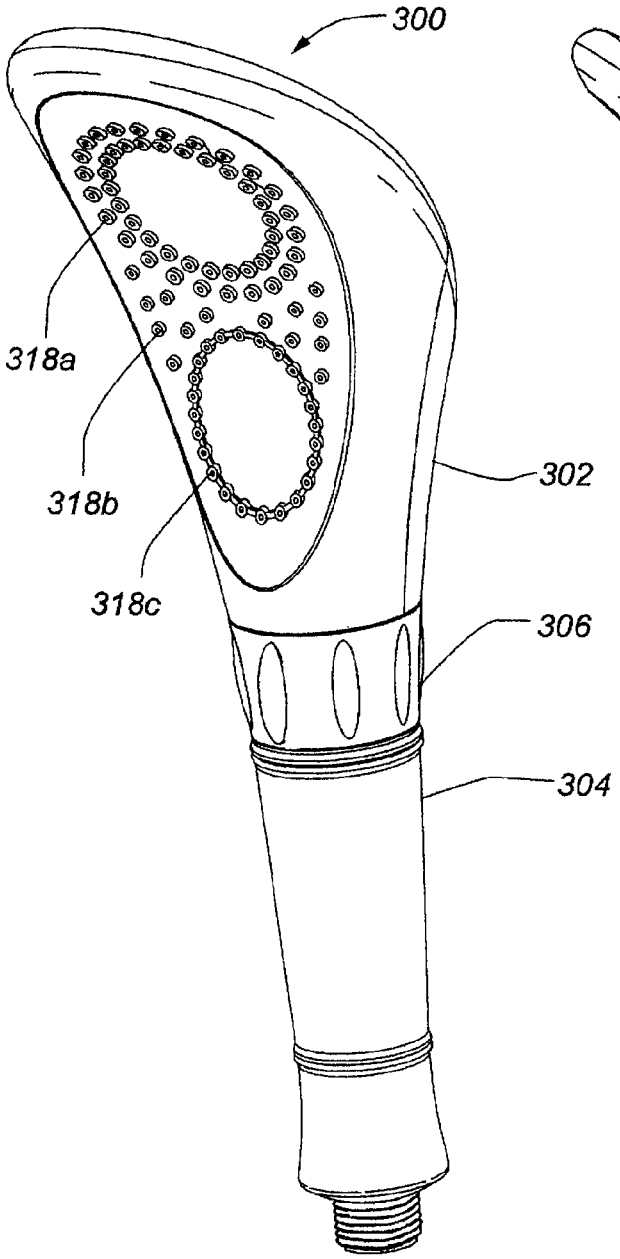
FIG. 11 is a front perspective view of a second embodiment of a handheld showerhead.
Figure 12:
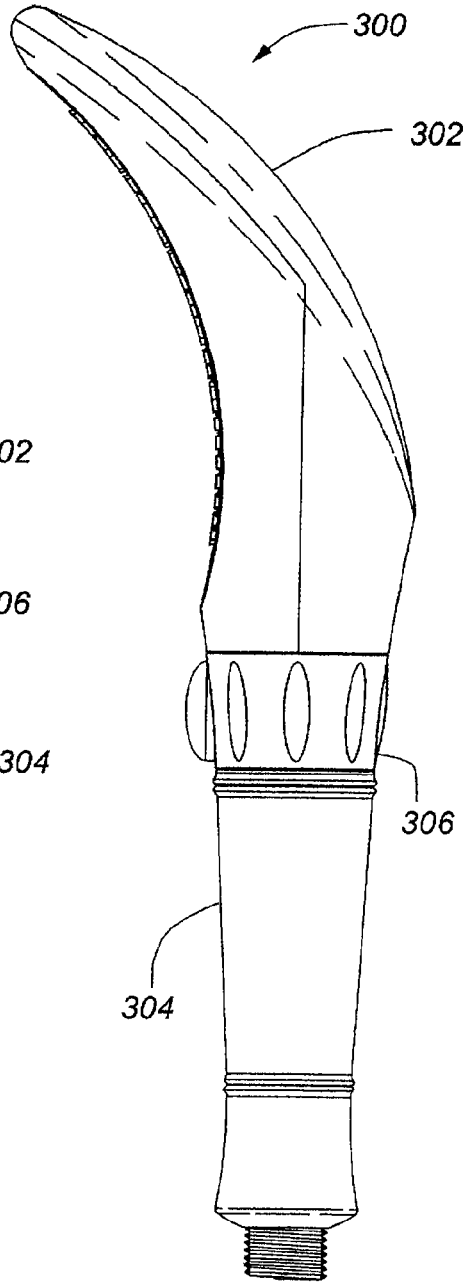
FIG. 12 is a side view of the handheld showerhead illustrated in FIG. 11.

Now turning to FIGS. 5, 9 and 10, the handle base 134 may define three base fluid apertures 160*a-c*, which may be circular or any other desired shape. Each base fluid aperture 160*a-c* fluidly communicates with one of the fluid channels in the handle portion 102. Generally, the number of base fluid apertures 160 match the number of fluid channels in the handle portion 102. In some embodiments, however, the handle base 134 may define more or less apertures than the number of fluid channels in the handle portion 102. For example, one fluid channel may fluidly communicate with two or more base fluid apertures 160 defined in the handle base 134, which may result in more base fluid apertures 160 than fluid channels. As yet another example, one base fluid aperture 160 may fluidly communicate with two or more fluid channels, which may result in less base fluid apertures 160 than fluid channels.

As described in more detail below, each base fluid aperture 160*a-c* may be selectively placed in fluid communication with the water supply connector 12. When a base fluid aperture 160*a-c* is selectively fluidly connected to the water supply connector 124, water flows from a water source in fluid communication with the water supply connector 124 into the fluid channel fluidly connected with the base fluid aperture 160*a-c*. From this fluid channel, water then flows into the fluid chamber fluidly connected with the fluid channel and out the nozzles 106 or openings 108 fluidly connected to the fluid chamber, thus delivering water in at least one of the showerhead spray modes to the user.

Referring back to FIG. 3, each group of nozzles 106*a-b* for a showerhead spray mode may or may not be part of a unitary structure. For example, the first group of nozzles 106*a* are part of a single, C-shaped member 162 sized for receipt in the fluid chamber fluidly associated with the nozzles 106*a*. Each nozzle 106*a* extends from the C-shaped member 162 and co-axially aligns with a hole 164 in the C-shaped member 162. The holes 164 in the C-shaped member, in turn, co-axially align with nozzles holes 166*a* formed in the showerhead 104 to receive the first group of nozzles 106*a*. Continuing with the example, the second nozzle group is not part of a unitary structure. Instead, each nozzle 106*b* is a separate element received in a nozzle hole 166*b* formed in the showerhead portion 104 for the second group of nozzles 106*b*.

With reference to FIGS. 1, 3 and 10, the mode selector 120 may include a control knob 122 having a generally cylindrical control knob body 172. Hand gripping recesses 174 may be formed in the control knob body 172. The hand gripping recesses 174 provide a recessed surface for a user to grasp when rotating the control knob 122 relative to the handle portion 102.

An annular control knob ring 176 may extend upwardly from an upper portion of the control knob body 172. The control knob ring 176 may define a control knob fastening aperture 178 on a to face thereof for receiving a handle connection shaft 180. As described in more detail below, the handle connection shaft 180 receives a mechanical fastener 171, such as a screw or the like, for rotatably joining the control knob 122 to the handle portion 102.

With further reference to FIGS. 3 and 10, the control knob rinq 176 may define a control knob fluid aperture 182 on a to face thereof. At select rotational positions of the control knob 122 relative to the handle portion 102, the control knob fluid aperture 182 aligns with one of the base fluid apertures 160*a-c*. Fluid communication between the water supply connector 124 and a base fluid aperture 160*a-c* occurs when the control knob fluid aperture 182 at least partially aligns with the base fluid aperture 160*a-c*. Rotation of the control knob 122 relative to the handle portion 102 changes which base fluid aperture 160*a-c* is in fluid communication with the water supply connector 124. More particularly, the control knob 122 may be rotated relative to the handle portion 102 from a first position where the control knob fluid aperture 182 at least partially aligns with one of the base fluid apertures 160*a-c* to a second position where the control knob fluid aperture 182 aligns with another of the base fluid apertures 160*a-c*, or with none of the base fluid apertures 160*a-c.a*

The base fluid apertures 160*a-c* and the control knob fluid aperture 182 may be sized and positioned to allow fluid communication between one base fluid aperture 160*a-c* and the water supply connector 124. However, the base fluid apertures 160*a-c* and/or the control knob fluid aperture 182 may be sized and/or positioned to form fluid communication between two or more of the base fluid apertures 160*a-c* and the water supply connector 124 at one or more relative rotational positions between the handle portion 102 and the control knob 122. Alternatively, in some embodiments, the control knob 122 may have two or more control knob fluid apertures 182 sized and positioned to provide at least partial concurrent fluid communication between one or more (e.g., two) of the base fluid apertures 160*a-c*. It may be desired to provide fluid communication between two or more base fluid apertures 160*a-c* when the handheld showerhead 100 is designed to provide two or more distinct spray modes concurrently.

Figure 6:
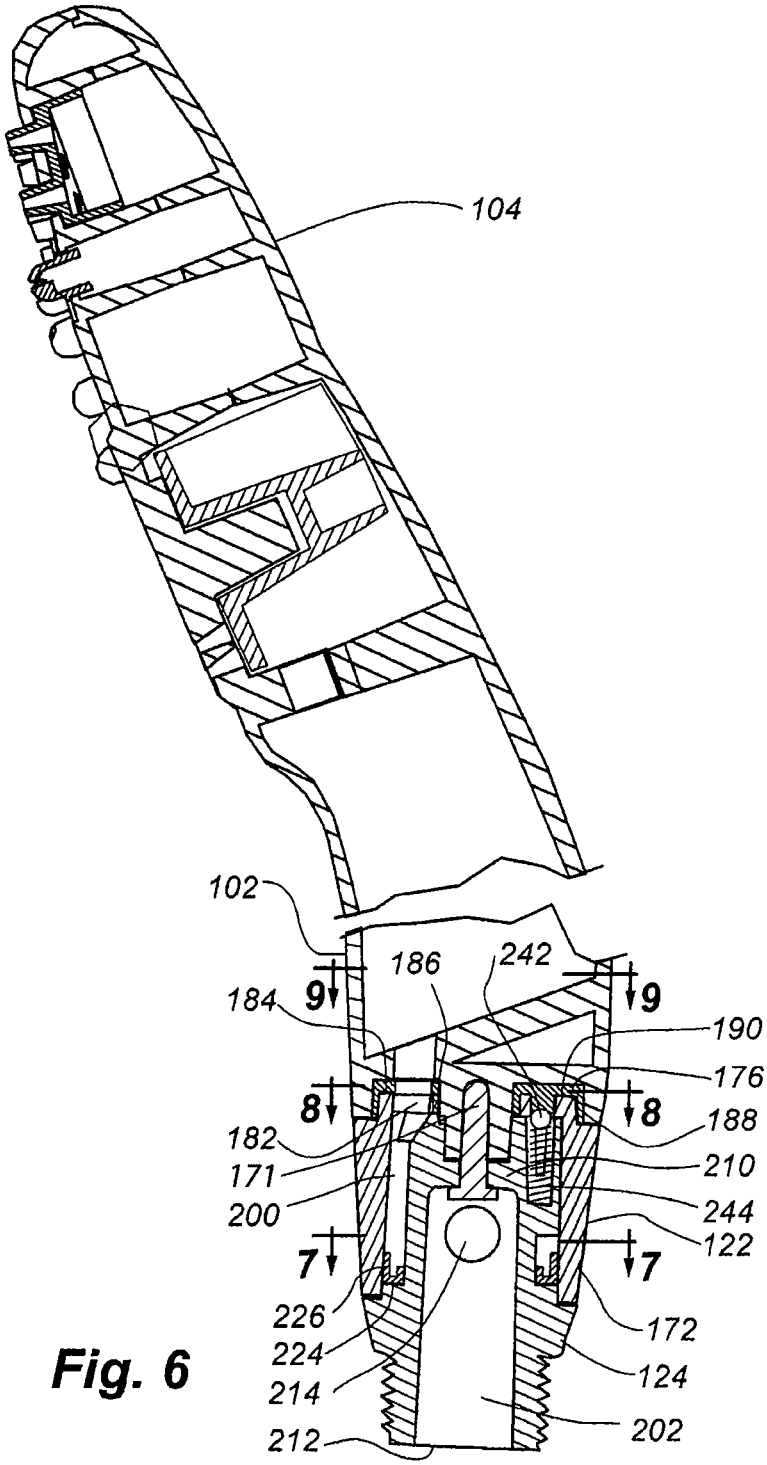
FIG. 6 is a cross-sectional view of the handheld showerhead of FIG. 1, taken along line 6-6 in FIG. 4.

With continued reference to FIGS. 3 and 10, a handle seal 184 may provide a liquid-tight seal between the control knob 122 and the handle portion 102. The handle seal 184 may include inner and outer seal sidewalls 186, 188 joined by an upper seal end wall 190. Turning to FIG. 6, the outer seal sidewall 188 and the upper seal end wall 190 generally abut the upper and side surfaces of the control knob ring 176. Referring back to FIG. 10, the inner seal sidewall 186 defines a seal fastening aperture 192 sized to receive the handle connection shaft 180 therethrough. Further, the inner seal sidewall 186 may be snug-tightly received within the control knob fastening aperture 178 as shown in FIG. 6.

Returning to FIGS. 3 and 10, the upper seal end wall 190 defines a seal fluid aperture 194. The seal fluid aperture 194 co-axially aligns with the control knob fluid aperture 182 to allow fluid to move between the control knob fluid aperture 182 and an aligned base fluid aperture 160*a-c*. To align the seal fluid aperture 194 with the control knob fluid aperture 182, the handle seal 184 and control knob 122 may include a keying feature. For example, a keying peg 196 may extend downwardly from the lower surface of the upper seal end wall 190 as shown in FIG. 10. A mating keying feature on the control knob 122, such as the keying recess 198 as shown in FIG. 3, may receive the keying peg 196 when the handle seal 184 is positioned properly relative to the control knob 122, thus helping to align the seal fluid aperture 194 with the control knob fluid aperture 182.

Keying features other than the one depicted in the figures and described above may be used. For example, a keying peg could be formed on the control knob 122 and a keying recess formed in the handle seal 184. As yet another example, the control knob ring 176 and the outer seal sidewall 188 may be asymmetrically shaped to provide a single position, or a limited number of positions, for joining the handle seal 184 to the control knob 122. The foregoing examples of keying features are merely illustrative and are not intended to limit other keying approaches. Further, the handle seal 184 and the control knob 122 may include two or more keying features.

With reference to FIG. 6, the handle seal 184 prevents fluid, such as water, from leaking through the joints formed between the handle portion 102, the control knob 122, and the water supply connector 124. More particularly, the control knob 122 and the water supply connector 124 may define a handle fluid chamber 200. The handle seal 184 prevents fluid from entering or exiting the handle fluid chamber 200 along a generally radially extending joint formed between the handle portion 102 and the control knob 122. Similarly, the handle seal 184 prevents fluid from entering or exiting a water supply connector fluid passage 202 defined by the water supply connector 124 along a pathway including a generally axially extending segment formed between the handle portion 102 and the water supply connector 124 and a generally radially extending segment formed between the control knob 122 and the handle portion 102.

Turning back to FIGS. 3 and 10, the water supply connector 124 may include a water supply connector shaft 210. As described above, a lower portion of the water supply connector shaft 210 may be externally threaded for threadedly joining the handheld showerhead 100 to a shower hose or the like. Other known methods for joining the handle portion to a shower hose or the like, such as press fitting, sonic welding and so on, may be used in lieu or, or in combination with, threadedly joining the water supply connector 124 to the shower hose 126. Further, a sealing element (not shown), for example an O-ring, may be used as well known in the art to seal the joint formed between the shower hose 126 and the water supply connector 124 from fluid leakage.

The water supply connector shaft 210 may define a water supply connector fluid inlet 212 near a lower end of the water supply connector shaft 210. The water supply connector fluid inlet 212 may co-axially align with the water supply connector shaft's longitudinal axial. The water supply connector shaft 210 may also define a water supply connector fluid outlet 214 in an upper portion of the water supply connector shaft 210. The water supply connector outlet 214 may be transverse relative to the water supply connector shaft's longitudinal axis.

The water supply connector shaft 210 may further define a water supply connector fluid passage 202 extending along at least a portion of water supply connector shaft's longitudinal axis as shown in FIG. 6. The water supply connector fluid passage 202 may fluidly join the water supply connector inlet 212 with the water supply connector fluid outlet 214. Thus, water or other fluid may flow from the water supply connector inlet 212 to the water supply connector fluid outlet 214, or vice versa, through the water supply connector fluid passage 202.

With reference to FIG. 6, the upper portion of the water supply connector shaft 210 and the control knob body 172 may define the handle fluid chamber 200. The handle fluid chamber 200 may be in fluid communication with the control knob fluid aperture 182 and the water supply connector fluid outlet 214. Thus, a fluid, such as water, may flow from a fluid source in fluid communication with the water supply connector 124 to the showerhead portion 104 when the control knob fluid aperture 182 aligns with at least one base fluid aperture 160*a-c*. More particularly, a fluid flows from a fluid source into the water supply connector fluid passage 202 through the water supply connector fluid inlet 212, and from the water supply connector fluid passage 202 to the handle fluid chamber 200 through the water supply connector fluid outlet. 214. Water may then flow from handle fluid chamber 200 to a fluid channel through the control knob fluid aperture 182 when the control knob fluid aperture 182 aligns with the fluid channel's respective base fluid aperture 160*a-c*. From the fluid channel, fluid flows to the showerhead fluid chamber in fluid communication with the fluid channel. Any showerhead nozzles 106 or openings 108 in fluid communication the showerhead fluid chamber then deliver water from the showerhead portion 104.

To change the showerhead spray mode (i.e., the set of nozzles 106 and/or openings 108 that deliver fluid from the showerhead portion 104), the control knob 122 may be selectively rotated relative to the handle portion 102 until the control knob fluid aperture 182 aligns with another base fluid aperture . Once aligned, fluid is delivered from the nozzles 106 or openings 108 in fluid communication with the fluid channel associated with the newly selected base fluid aperture 160*a-c*. When the control knob fluid aperture 182 does not align with any of the base fluid apertures 160*a-c*, then no fluid flows to the showerhead portion 104 since no fluid channels are in fluid communication with the handle fluid chamber 200.

Returning back to FIGS. 3 and 10, an intermediate water supply connector flange 200 may extend outwardly from the water supply connector shaft 210. The intermediate water supply connector flange 220 may step to form an outer intermediate flange surface 222 and an inner intermediate flange surface 224. As shown in FIG. 6, a seal element, such as a cup seal, they rest on the inner intermediate flange surface 224. The seal element 226 provides a seal between the water supply connector 124 and the control knob 122 to prevent water from leaking through the joint formed between them.

With reference to FIGS. 3 and 10, an upper water supply connector flange 230 may extend outwardly from an upper end of the water supply connector shaft 210. The upper water supply connector flange 230 may optionally include inwardly curved recesses around its perimeter to enhance the aesthetics of the water supply connector 124, or may be any other shape that fits within the open space defined by the control knob body 172. The upper water supply connector flange 230 may define a connector fastening hole 232 for receiving the handle connection shaft 180. The shape of the connector fastening hole 232 may generally match the cross-sectional area of a lower portion of the handle connection shaft 180. As shown in FIG. 10, the lower portion of the handle connection shaft may form a generally non-circular cross-sectional area, such a hexagonal area. The non-circular cross-sectional area prevents the water supply connector 124 from rotating relative to the handle portion 102, when joined to the handle portion 102 by the fastener 171.

An upper portion of the handle connection shaft 180 may be a generally cylindrical shaft, which may be received through the control knob fastening aperture 178 and may generally abut the inner seal sidewall 186 as shown in FIG. 6. The circular perimeter of the upper portion of the handle connection shaft 180 permits selective rotation of the handle seal 184 and the control knob 122 relative to the handle portion 102 and the water supply connector 124. The handle connection shaft 180 may include a fastener aperture 234 for receipt of a screw or other mechanical fastener (not shown). The mechanical fastener maintains the connection between the handle portion 102, the control knob 122, and the water supply connector 124.

Figure 7A:
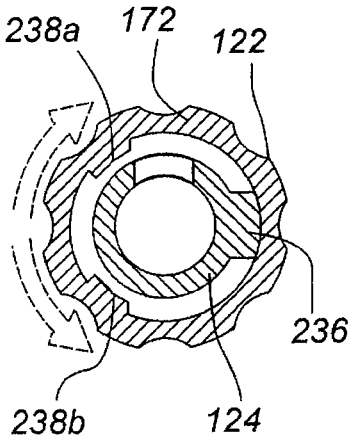
FIG. 7A is a cross-sectional view of the handheld showerhead illustrated in FIG. 1, taken along line 7-7 in FIG. 6.
Figure 7B:
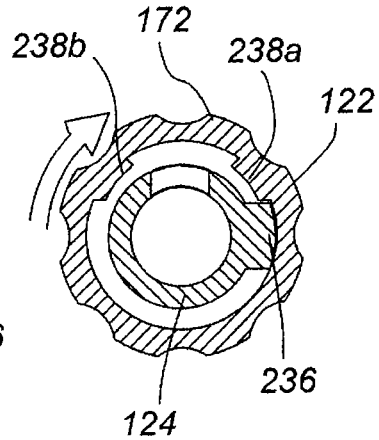
FIG. 7B is a cross-sectional view similar to FIG. 7A showing the control knob stop tab abutting the water supply connector stop.
Figure 7C:
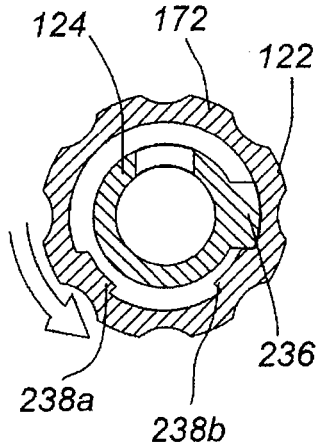
FIG. 7C is cross-section view similar to FIG. 7A showing the control knob rotated counter-clockwise relative to the water supply connector.

A stop 236 may optionally extend from the upper water supply connector flange 230 along at least a portion of the length of the water supply connector shaft 210. As shown in FIGS. 7A-7C, a pair of stop tabs 238*a-b* may extend inwardly from an inner surface of the control knob body 172. Engagement of a stop tab 238*a-b* with the stop 236 limits further rotation of the control knob 122 relative to the water supply connector 124 in the direction resulting in such engagement. For example as shown in FIG. 7A, further clockwise rotation of the control knob 122 relative to the water supply connector 124 is prevented by engagement of a stop tab 238*a* with the stop 236.

With reference to FIG. 3, the water supply connector 124 may include a plunger aperture 240 extending from the upper water supply connector flange 230 along at least a portion of the length of the water supply connector shaft 210. The plunger aperture 240 may receive a plunger 242 and a plunger spring 244. The plunger 242 may provide a physical indication of when a spray mode is selected and may prevent inadvertent rotation of the control knob 122 relative to the handle portion 102. More particularly and with reference to FIGS. 3 and 6, the plunger 242 may include a plunger shaft ending in a generally curved plunger flange. The inner side of the control knob ring 176 may include plunger recesses for engagement with the plunger 242. Each plunger recess may be generally positioned to co-axially align with the plunger 242 when the control knob fluid aperture 182 aligns with a base fluid aperture 160*a-c*. The plunger 242 may take forms other than a shaft with a flange. For example, the plunger may be a ball supported by the plunger spring 244.

The plunger spring 244 biases the plunger 242 into an aligned plunger recess on the control knob 122. Movement of the plunger 242 into a plunger recess by aligning the plunger recess with the plunger 242 by rotating the control knob 122 relative to the handle portion 102 may provide a physical indication that a control knob fluid aperture 182 is aligned with a base fluid aperture 160*a-c*. Once aligned, a rotational force sufficient to overcome the spring force biasing the plunger 242 into the plunger recess may be required to continue rotating the control knob 122 relative to the handle portion 102. Thus, the plunger 242 may also prevent further rotational movement of the control knob 122 relative to the handle portion 102 until the user exerts a sufficient force to overcome the spring force biasing the plunger into the plunger recess.

FIGS. 11-20 depict a second embodiment of a handheld showerhead 300 with mode control. The second embodiment generally operates in a manner similar to the first embodiment. More particularly and with reference to FIG. 11, the second embodiment may include a showerhead portion 302 with three sets of nozzles 318*a-c* providing three showerhead spray modes, a handle portion 304 for a user to grasp, and a control knob 306 selectively movable relative to the handle portion 304 to select a showerhead spray mode.

Although the second embodiment operates in a similar manner to the first embodiment, the individual components may be slightly modified. For example, the handle portion 304 and the showerhead portion 302 may be separate components rather integrally formed to form a body for the handheld showerhead 300. As another example, the control knob 306 may be positioned between the showerhead portion 302 and the handle portion 304 rather than positioned at the lower end of the handle portion 304. As yet another example and with reference to FIGS. 13, 14, and 16, the water supply connector shaft 308 may be longer than the comparable shaft in the first embodiment.

Figure 13:
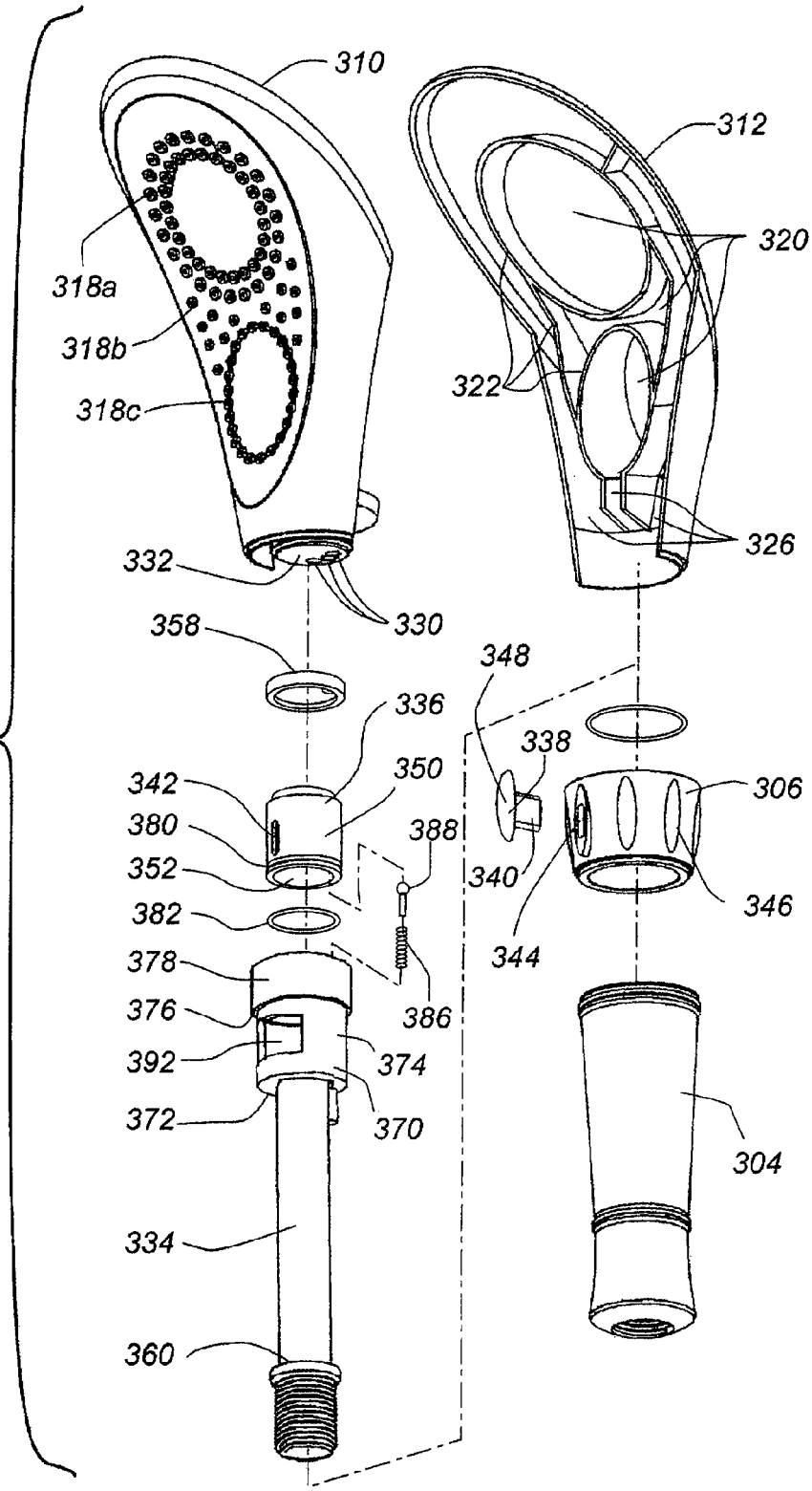
FIG. 13 is an exploded front perspective view of the handheld showerhead illustrated in FIG. 11.
Figure 14:
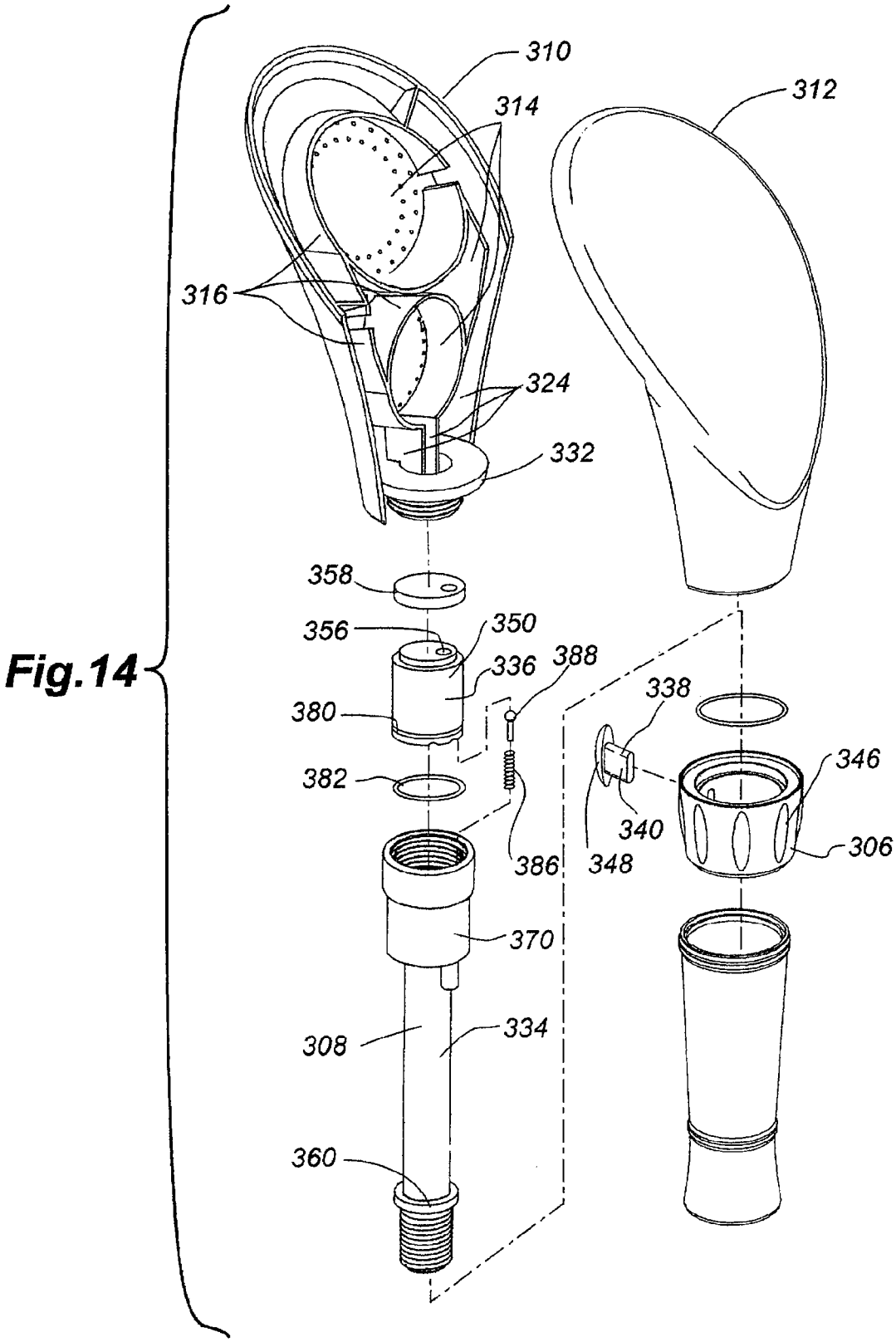
FIG. 14 is an exploded rear perspective view of the handheld showerhead illustrated in FIG. 11.
Figure 15:
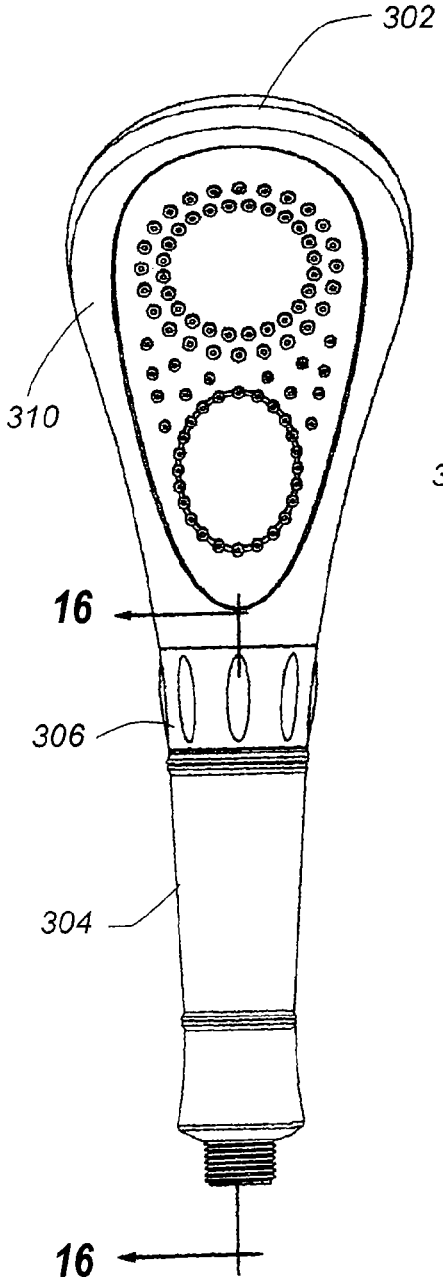
FIG. 15 is a front view of the handheld showerhead illustrated in FIG. 11, with the control knob rotated to a second position.

With reference to FIGS. 11-16, the showerhead portion 302 may include a front showerhead portion 310 and a rear showerhead portion 312. Similar to the first embodiment, the front showerhead portion 310 may include three front showerhead fluid chambers 314 defined by front showerhead sidewalls 316 and in fluid communication with one set of nozzles 318*a-c*, and the rear showerhead portion 312 may include three rear showerhead fluid chambers 320 defined by rear showerhead sidewalls 322. Together the front and rear showerhead fluid chambers 314, 320 may define showerhead fluid chambers in fluid communication with sets of showerhead nozzles 318. Together front and rear fluid channels 324, 326 defined within each showerhead portion 310, 312 provide fluid communication between the showerhead fluid chambers and base fluid apertures 330 defined by a showerhead base 332 as shown in FIGS. 13, 14 and 17.

As described above, the front and rear showerhead sidewalls 316, 322 may be heat welded, sonic welded, or otherwise connected to form fluid-tight seals along between their respective joints. Sidewalls for the front and rear channels 324, 326 may be similarly joined to form fluid tight channels with the showerhead portion 302. Alternatively or conjunctively, tubes or other fluid conveyance structures may be positioned or defined within the showerhead portion 302 to provide fluid communication between the showerhead fluid chambers and showerhead portion base apertures 330.

Figure 16:
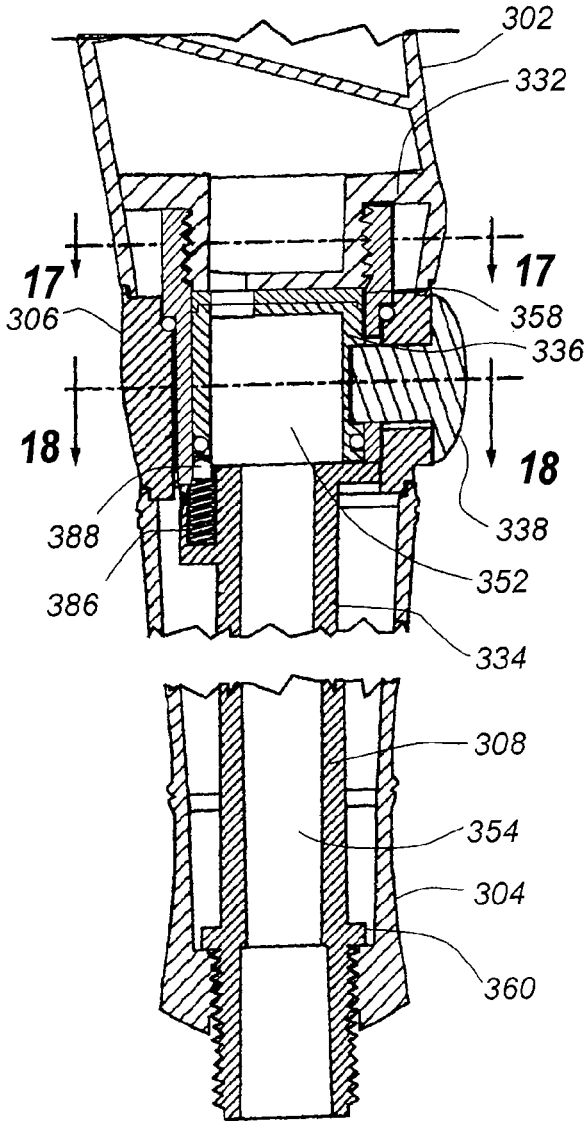
FIG. 16 is a partial cross-sectional view of the handheld showerhead illustrated in FIG. 11, taken along line 16-16 in FIG. 15.
Figure 17:
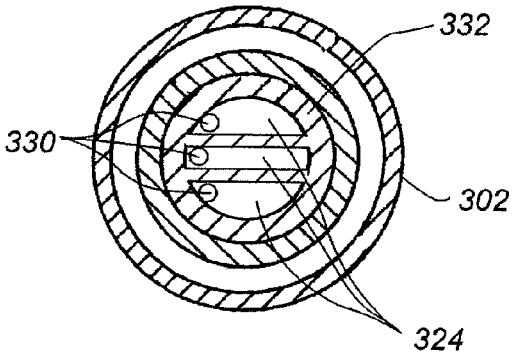
FIG. 17 is a cross-sectional view of the handheld showerhead illustrated in FIG. 11, taken along line 17-17 in FIG. 16.

Turning to FIGS. 13, 14 and 16, a lower portion of a showerhead base 332 may be externally threaded for threadedly joining a water supply connector 334 to the showerhead portion 302. Similarly, a lower portion of the water supply connector shaft 308 may be externally threaded for threadedly joining the handle portion 304 to the water supply connector 334. Connection methods other than threaded connections may be used in place of, or in combination with, threadedly joining the water supply connector 334 to the showerhead portion 302, and the handle portion 304 to the water supply connector 334. In a manner similar to the one described above in connection with the first embodiment, the water supply connector 334 may be joined to a shower hose or the like.

With reference to FIGS. 13, 14, 16 and 18, the mode selector may include the control knob 306 and a control ring 336 joined together by a control tab 338. More particularly, the control tab 338 may include a control tab shaft 340 with a generally rectangular cross-sectional area, or other desired to shape. Aligned control ring and control knob slots 342, 344 may receive the control tab shaft 340. The control tab 338 operatively connects the control ring 336 with the control knob 306. More particularly, as the control knob 306 rotates relative to the handle portion 304, the control tab 338 transfers this rotational motion to the control ring 336, thus causing the control ring 336 to rotate in conjunction with the control knob 306. The connection between the received control tab shaft 340 and the control ring and control knob slots 342, 344 may be maintained by press fit, adhesives, heat or sonic welds, any other suitable connection method, or any combination thereof.

Like the first embodiment, the control knob 306 may include finger gripping features, such as projections 346, spaced around its exterior for grasping by the fingers of a user to aid the user in rotating the control knob 306 relative to the handle portion 304. Additionally, rotating the control knob 306 relative to the handle portion 304 may be facilitated by an arcuate shaped cap 348, or other shaped cap, formed at an end of the control tab 338. As a user rotates the control knob 306 relative to the handle portion 304, the control ring 336 also rotates relative to the handle portion 304 via the joining of the control knob 306 to the control ring 336 by the control tab 338.

With continued reference to FIGS. 13, 14, and 16 the control ring 336 may include a generally cylindrical control ring body 350 open at a lower end and generally closed at an upper end. The control ring body 350 may define a handle fluid chamber 352 in fluid communication with a fluid passage 354 defined by the water supply connector shaft 308. The control ring body's upper end may define a control ring fluid aperture 356. The control ring fluid aperture 356 may be aligned with one or more of the showerhead portion base fluid apertures 330 in a manner similar to the one described above for aligning the control knob fluid aperture with a base fluid aperture in the first embodiment. Further, as described in more detail above, selective alignment of the control ring fluid aperture 356 with the showerhead portion base fluid apertures 330 allows a user to select a showerhead spray mode.

The upper end of the control ring body 350 may step inwardly to define a space between the handle portion 304, the showerhead portion 302 and the control ring 336 for receiving a cup seal, or ring, or other appropriate seal member 358. The seal member 358 may be similar to the handle seal described above for the first embodiment. The seal member 358 prevents fluid leakage between the joint formed between the showerhead portion 302, handle portion 304 and the control ring 336.

With reference to FIGS. 13, 14, 16 and 20, the water supply connector 334 may include a handle stop flange 360 extending about a lower portion of the water supply connector 334 shaft proximate the external threads. The handle stop flange 360 may engage a stepped interior surface of the handle portion 304 to indicate when the handle portion 304 is fully threaded on the water supply connector 334 and to limit further upward movement of the handle portion 304 relative to the water supply connector 334.

The water supply connector 334 may include a water supply collar 370 positioned at the upper end of the water supply connector shaft 308. As shown best in FIG. 13, the water supply connector collar 370 may include a lower collar flange 372 extending radially outwardly from an upper end of the water supply connector shaft 308, a lower collar sidewall 374 extending upwardly from the lower collar flange 372, an upper collar flange 376 extending radially outwardly from an upper end of the lower collar sidewall 374, and an upper collar sidewall 378 extending upwardly from the upper collar flange 376. As shown best in FIG. 16, the lower collar sidewall 374 may define a lower collar chamber for receipt of the control ring 336. Further, the control ring 336 abuts the lower collar flange 372, which prevents downward movement of the control ring 336 relative to the water supply connector 334.

With reference to FIGS. 13, 14, 16 and 19, the control ring 336 may further include an annular control ring groove 380 formed in a lower portion of an outer surface of the control ring 336. The control ring groove 380 may receive a lower O-ring 382 to prevent fluid leakage through the joint formed by the control ring 336 and the water supply connector 334. Although the groove from received the lower O-ring is depicted and described above as formed in the control ring 336, it may be formed in the control ring 336, the water supply connector 334, or both.

Like the first embodiment, the water supply connector 334 for the second embodiment may include a plunger aperture 384 for receipt of a plunger spring 386 and a plunger 388 as shown in FIGS. 13, 14, 16 and 20. The plunger spring 386 and plunger 388 operate in a manner similar to the one described above with respect to the first embodiment except the plunger 388 engages recesses 390 formed in the bottom surface of the control ring 336 (see FIG. 19) rather than recesses in the control knob. The plunger 388, plunger spring 386, and control ring recesses 390 cooperate to perform functions similar to those functions performed by similar elements in the first embodiment.

Figure 18:
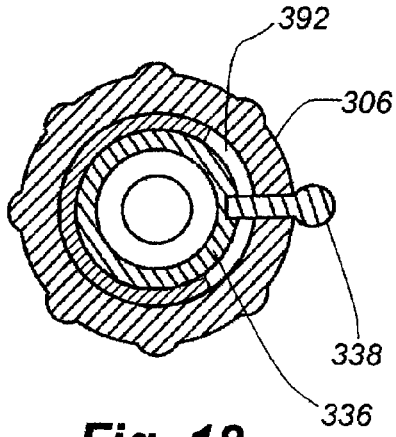
FIG. 18 is a cross-sectional view of the handheld showerhead illustrated in FIG. 11, taken along line 18-18 in FIG. 16.
Figure 19:
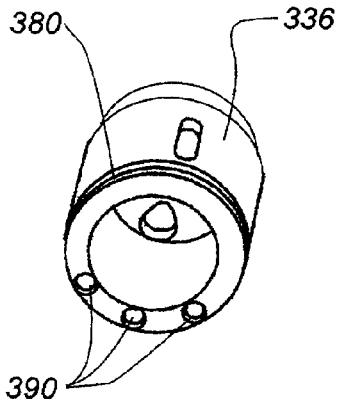
FIG. 19 is a bottom perspective view of the control ring for the handheld showerhead illustrated in FIG. 11.
Figure 20:
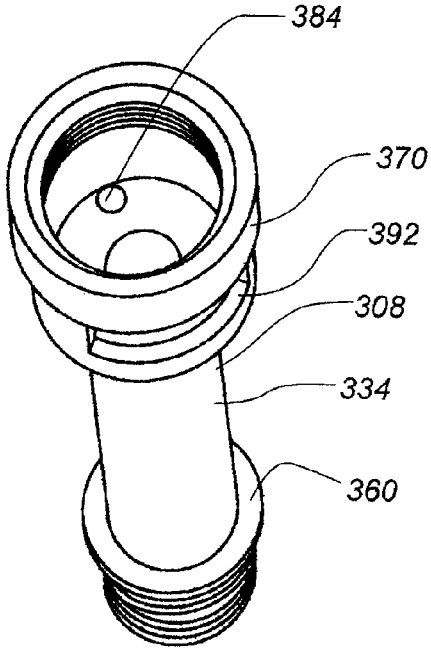
FIG. 20 is a top perspective view of the water supply connector for the handheld showerhead illustrated in FIG. 11.

Turning to FIGS. 13, 18 and 20, the lower collar sidewall 374 defines a collar tab aperture 392. The collar tab aperture 392 may receive the collar tab 338 therethrough. The collar tab aperture 392 limits rotation of the control knob 306 relative to the handle portion 304. More particularly, as the collar tab 338 rotates relative to the handle portion 304, it engages a vertical side of the lower collar sidewall 374 defining the collar tab aperture 392. Once engaged, further rotation of the control knob 306 (and the control ring 336) in that direction is prevented. The control knob's range of rotation may be increased or decreased by respectively increasing or decreasing the size of the collar tab aperture 392.

The upper collar sidewall 378 may define an upper collar chamber to receive seal member 358 and the showerhead portion base 332 as shown in FIG. 16. The showerhead portion base 332 may bear against the seal member 358, which in turn bears on the control ring 336, thus preventing further downward movement of the showerhead portion 302 relative to the water supply connector 334.

FIGS. 21-29 depict a third embodiment of a handheld showerhead 400 with mode control. The third embodiment generally operates in a manner similar to the first two embodiments. More particularly and with reference to FIG. 21, the third embodiment may include a showerhead portion 402 with four sets of nozzles 404 or openings 406 providing four showerhead spray modes, a handle portion 408 for a user to grasp, and a control knob 410 selectively movable relative to the handle portion 408 to select a showerhead spray mode.

Figure 27:
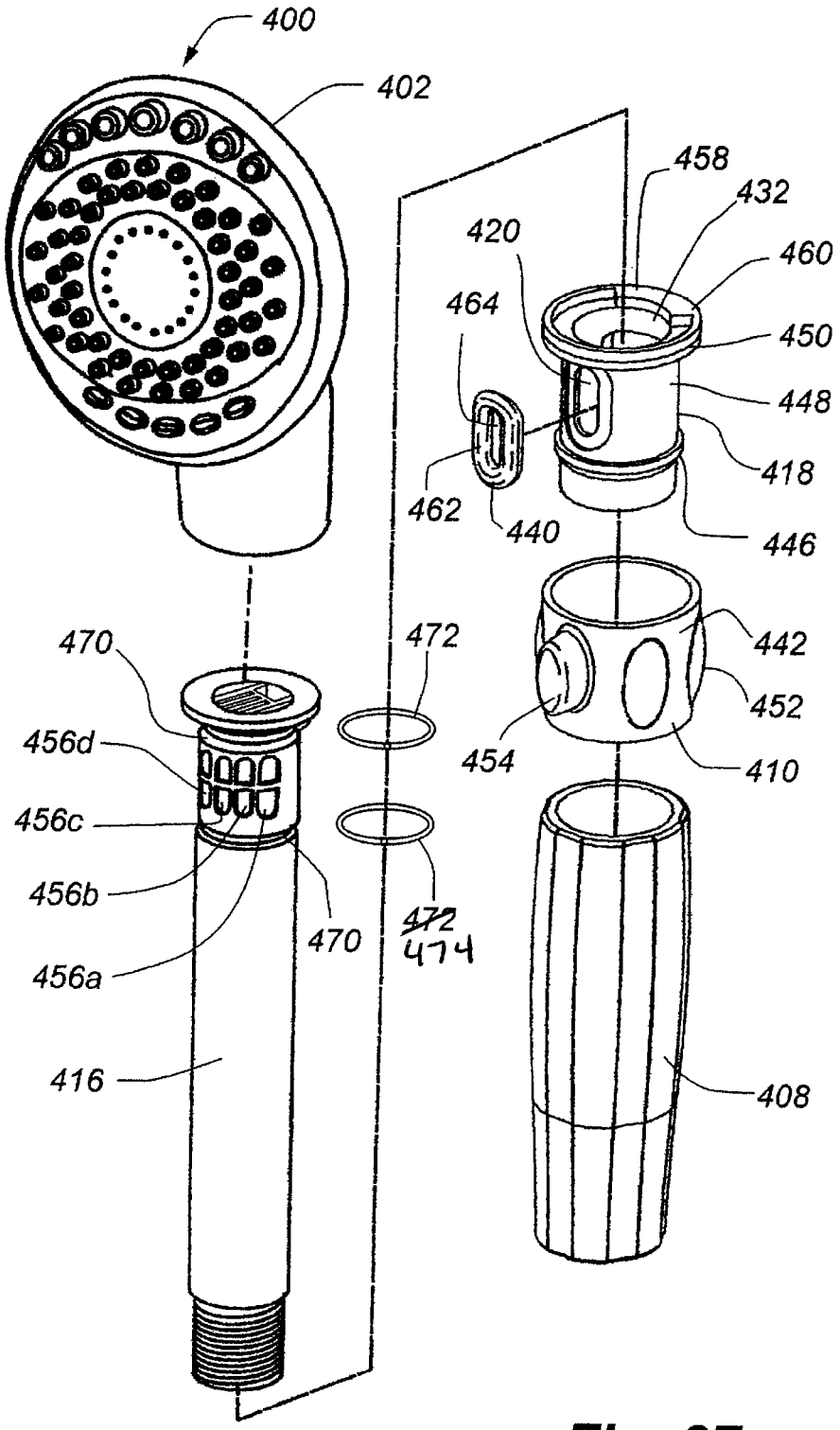
FIG. 27 is a front exploded perspective view of the handheld showerhead depicted in FIG. 21.

Although the third embodiment operates in a manner similar to the first and second embodiments, the individual components may be slightly modified. For example, the handle portion 408 and the showerhead portion 402 may be separate components rather integrally formed as shown in FIG. 27. As another example, the control knob 410 may be positioned between the showerhead portion 402 and the handle portion 408 rather than positioned at the lower end of the handle portion.

Figure 21:
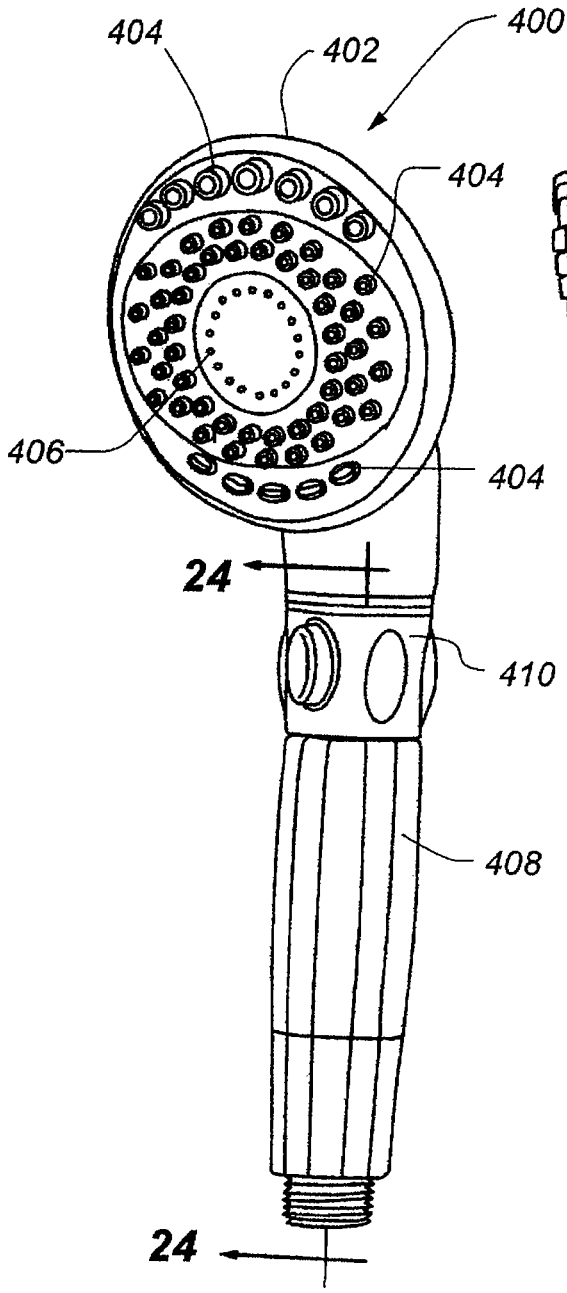
FIG. 21 is a front perspective view of a third embodiment of a handheld showerhead.
Figure 22:
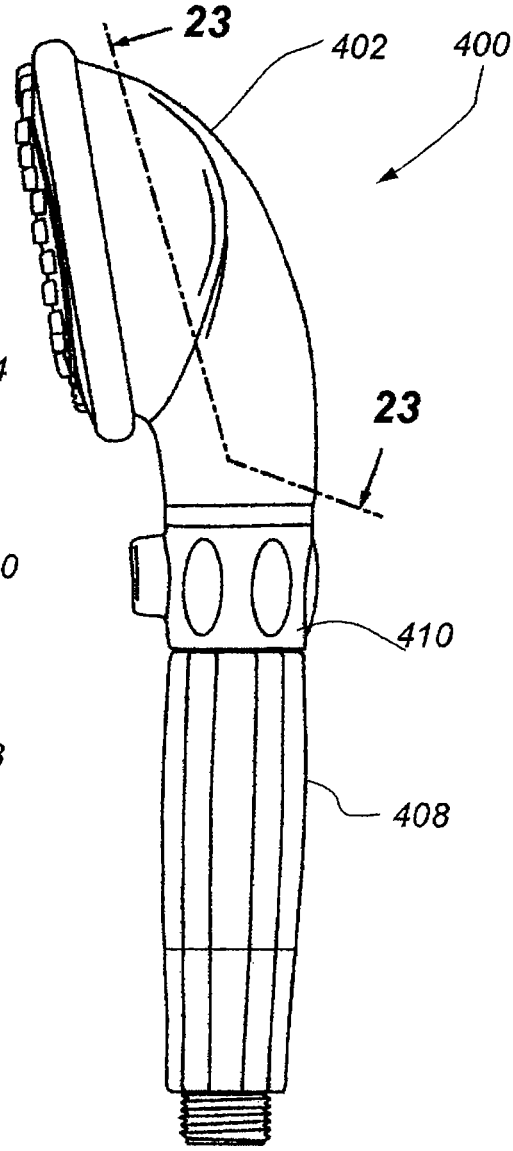
FIG. 22 is a side view of the handheld showerhead shown in FIG. 21.
Figure 23:
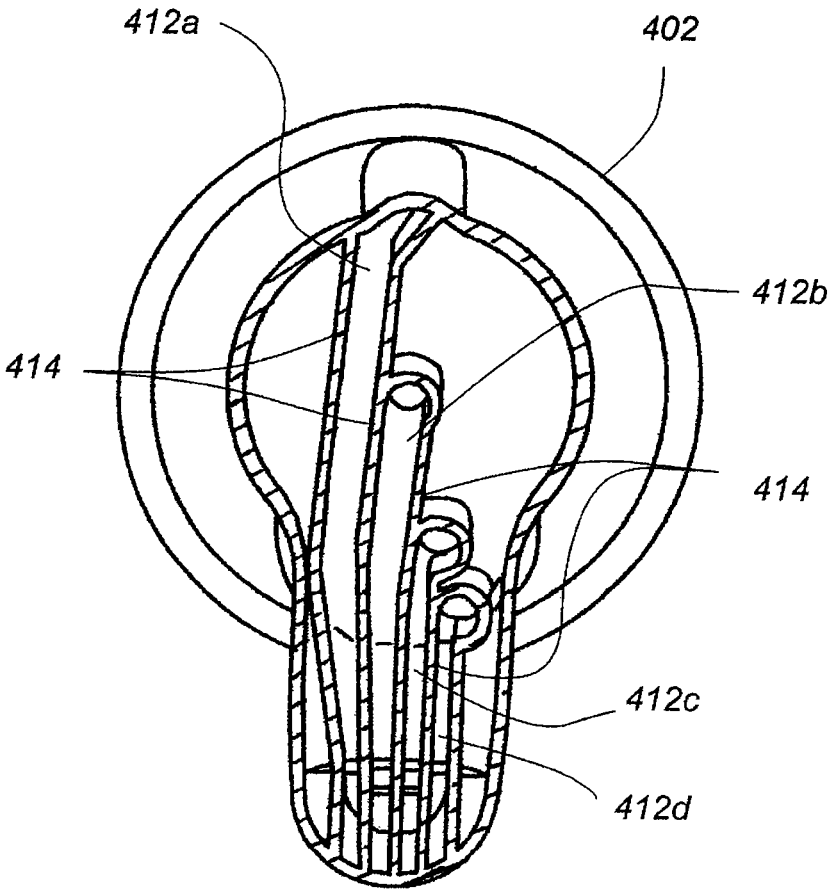
FIG. 23 is a cross-sectional view of the handheld showerhead depicted in FIG. 21, taken along line 23-23 in FIG. 22.

With reference to FIGS. 21 and 22, the third embodiment may include four sets of nozzles 404 and/or openings 408 for delivering fluid from the showerhead portion 402 in up to four spray modes. Each set of nozzles 404 and/or openings 406 may fluidly communicate with a one or more distinct showerhead fluid chambers defined within the showerhead portion 402 like the other embodiments. Turning to FIG. 23, each showerhead fluid chamber, in turn, may be in fluid communication with a fluid channel 412*a-d* defined by fluid channel sidewalls 414. As with other embodiments, more than fluid channel 412 may fluidly communicate with a showerhead fluid chamber.

With reference to FIGS. 23-26, each fluid channel 412*a-d* may extend from the showerhead portion 402 to the water supply connector 416 for the showerhead. The fluid channels 412*a-d* terminate proximate a valve core 418. As described in more detail below, rotation of the valve core 418 relative to the water supply connector 416 selectively aligns a valve core fluid outlet 420 with one or more of the fluid channels 412*a-d*. When the valve core fluid outlet 420 aligns with the one or more of the fluid channels 412*a-d*, a fluid, such as water, flows through the valve core outlet 420 into the fluid channel 412*a-d* and through the set of nozzles 404 and/or openings 406 in fluid communication with the fluid channel 412*a-d*.

Figure 24:
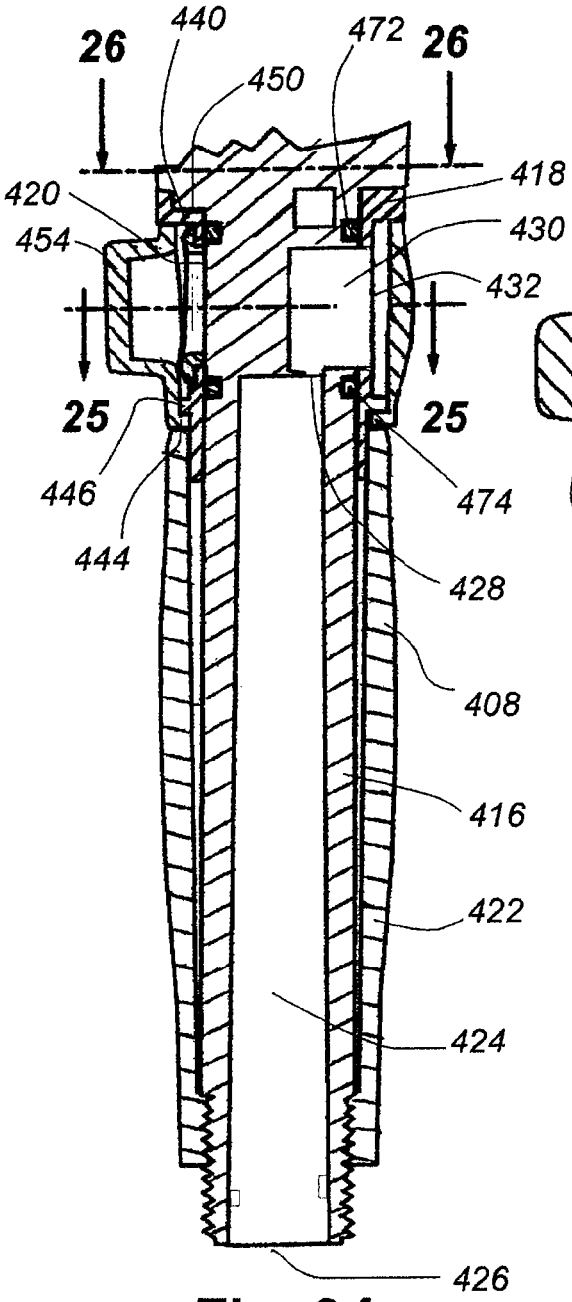
FIG. 24 is a cross-sectional view of the handheld showerhead depicted in FIG. 21, taken along line 24-24 in FIG. 21.

As best shown in FIG. 24, a lower portion of the water supply connector 416 may be received within the handle portion 408. More particularly, the handle portion 408 may include a handle body 422 defining an elongated cylindrical aperture for receiving a cylindrical lower portion of the water supply connector 416. An interior surface of the handle body 422 may be threaded near its bottom end to mate with exterior threads formed near a bottom portion of the water supply connector 416. As described in more detail above for the other embodiments, the handle portion 408 may be joined to the water supply connector 416 by any other fastening means or methods, or a combination of fastening means and/or methods.

With continued reference to FIG. 24, the lower portion of the water supply connector 416 may define a fluid passage 424 having a fluid inlet 426 in fluid communication with a shower hose or the like (not shown). Proximate the valve core 418, the fluid passage 424 may terminate in a water supply connector fluid outlet 428 in fluid communication with a water supply connector fluid chamber 430. The water supply connector fluid chamber 430, in turn, may be in fluid communication with a valve core fluid inlet 432.

Figure 25:
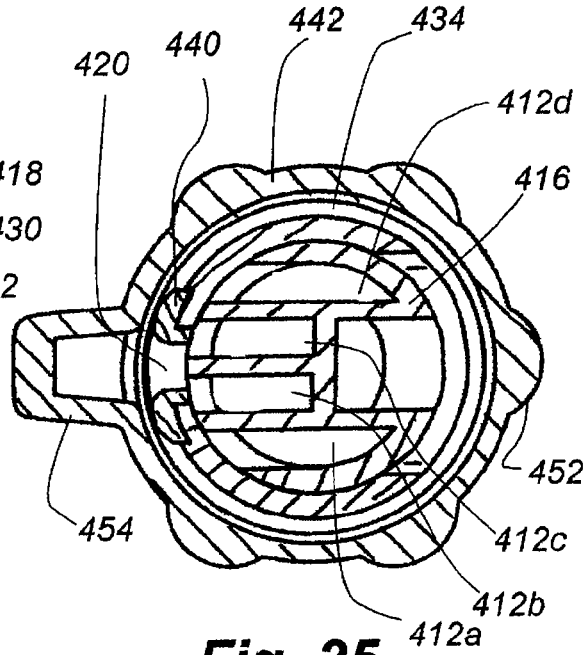
FIG. 25 is cross-sectional view of the handheld showerhead depicted in FIG. 21, taken along line 25-25 in FIG. 24.
Figure 26:
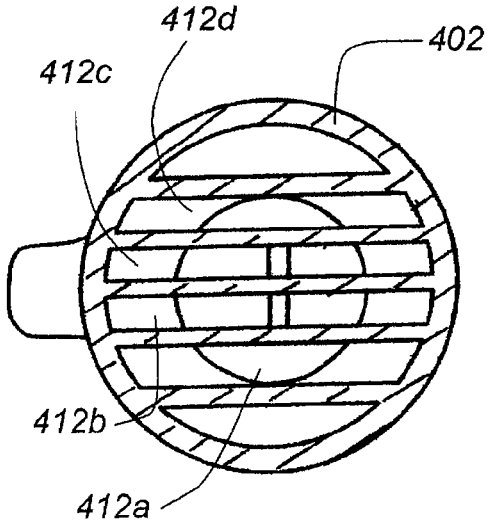
FIG. 26 is a cross-sectional view of the handheld showerhead depicted in FIG. 21, taken along line 26-26 in FIG. 24.
Figure 28:
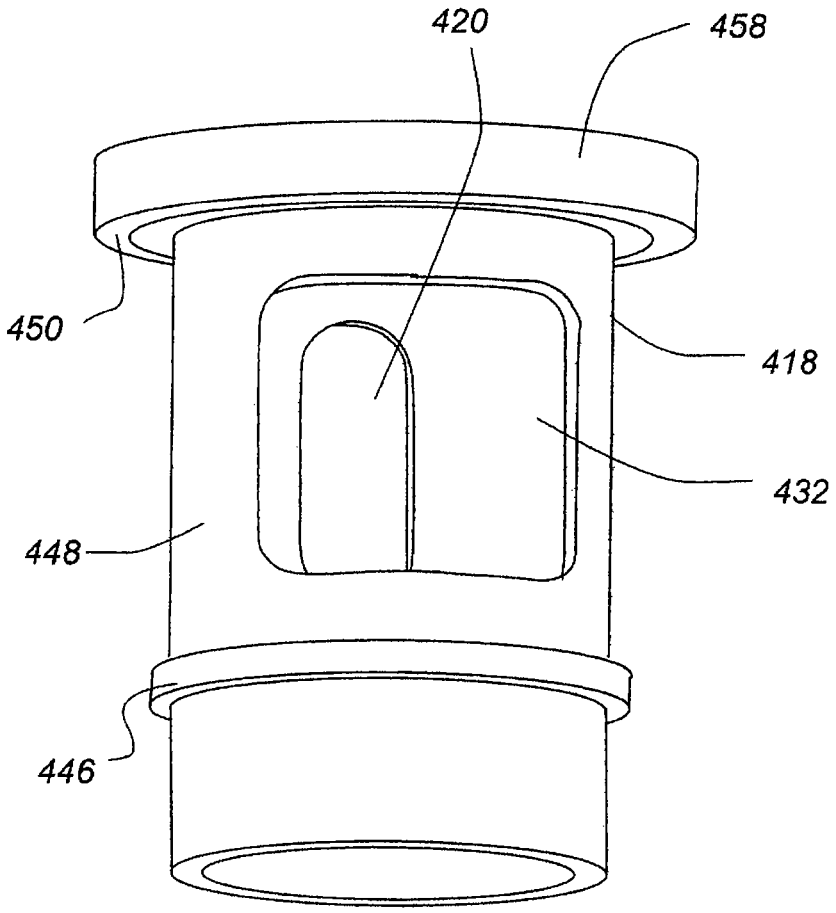
FIG. 28 is a perspective view of the valve core for the handheld showerhead depicted in FIG. 21.

With reference to FIGS. 24 and 25, the exterior surface of the valve core 418 and the interior surface of the control knob 410 may define a generally annular handle fluid chamber 434. The handle fluid chamber 434 may be in fluid communication with a valve core fluid inlet 432 and the valve core fluid outlet 420. The valve core fluid inlet 432 may be diametrically opposite the valve core fluid outlet 420 as shown in FIGS. 24, 27 and 28, or may be positioned at other locations on the valve core 418 relative to the valve core fluid inlet 432.

The core valve fluid outlet 420 may receive a valve seal 440. The valve seal 440 prevents fluid from flowing from the valve core fluid outlet 420 to a fluid channel 412*a-d* unless the valve core outlet 420 is at least partially aligned with it. As shown in FIG. 25, the valve core fluid outlet 420 may be partially aligned with two or more fluid channels 412*a-d*, thus allowing fluid to flow to each of these fluid channels 412*b-c* through the valve core fluid outlet 420. As described in more detail below, alignment of the valve core fluid outlet 420 to a fluid channel 412*a-d* may be selectively changed by selective rotation of the valve core 418 relative to the water supply connector 416.

With reference to FIGS. 23-26, the fluid flow path within the handheld showerhead 400 will be described. Fluid flows from a fluid source to the fluid passage 424 in the water supply connector 416 via the water supply connector fluid inlet 426. From the fluid passage 424, fluid flows to the water supply connector fluid chamber 430 via the water supply connector fluid outlet 428. Fluid then flows from the water supply connector fluid chamber 430 to the handle fluid chamber 434 through the valve core fluid inlet 432.

Fluid in the handle fluid chamber 434 flows to any fluid channel 412*a-d* at least partially aligned with the valve core fluid outlet 420. From each of the one or more aligned fluid channels 412*a-d*, fluid flows to the respective fluidly connected showerhead fluid chambers and is delivered from the showerhead portion 402 via the set of nozzles 404 and/or openings 406 in fluid communication with such showerhead fluid chambers. Selective rotation of the valve core 418 relative to the water supply connector 416 changes which fluid channels 412*a-d* align with the valve core fluid outlet 432, and thus permits a user to select which set of nozzles 404 and/or openings 406 (i.e., which shower spray mode) provide fluid from the showerhead.

With reference to FIGS. 24 and 27, the control knob 410 may include a generally cylindrical control knob body 442. A lower control knob flange 444 may extend radially inward from a bottom portion of the control knob body 442. As shown best in FIG. 24, the lower control knob flange 444 may abut a lower valve core flange 446. With reference to FIGS. 24 and 27, the lower valve core flange 446 may extend radially outward from a generally cylindrical valve core body 448. Abutting the lower control knob flange 444 with the lower valve core flange 446 provides a contact surface for joining the lower end of the control knob 410 with the lower end of the valve core 418.

With reference to FIGS. 24, 27 and 28, an upper valve core flange 450 may extend radially outward from an upper end of the valve core body 448. As best shown in FIG. 24, the upper valve core flange 450 may overlap the upper portion of the control knob body 442, thus providing a contact surface for joining the upper end of the control knob 410 with the upper end of the valve core 418. The upper and lower ends of the control knob 410 and the valve core 418 may be joined together using heat welds, sonic welds, adhesives, any other connection method forming a liquid-tight seal between the joints formed by the control knob and the valve core, or any combination thereof. When joined, rotation of the control knob 410 is transmitted to the valve core 418, thus rotating the valve core 418 relative to the water supply connector 416 when a user selectively rotates the control knob 410 relative to the handle portion 408.

With reference to FIGS. 25 and 27, one or more generally convexly curved, oval-shaped projections 452 may extend from an outer surface of the control knob body 442. The projections 452 may enhance the visual appeal of the handheld showerhead 400 and/or enhance a user's ability to grip the control knob 410 for rotating the control knob 410 relative to the handle portion 408. A finger hold projection 454 may also extend from an outer surface of the control knob body 442 to provide another hand grasping feature to aid a user in rotating the control knob 410. The finger hold projection 454 may have a generally oval shape with a slightly recessed upper surface generally conforming to the shape of a thumb or finger tip for engagement with a user's fingers. Although described and depicted as oval shaped, the projections 452 and the finger hold projection 454 may be any desired shape.

With reference to FIGS. 24, 27 and 28, the valve core body 448 may define a generally square shaped valve core fluid inlet 432, or any other shaped inlet. The valve core fluid inlet 432 along the circumference of the valve core 418 may be sufficiently sized to allow fluid to flow from the water supply connector fluid chamber 430 to the handle fluid chamber 434 through the range of rotational alignments of the valve core fluid outlet 420 and the fluid channels 412*a-d*. The valve core body 448 may define a generally oval shaped valve core fluid outlet 420, or other shaped outlet, which may approximately match the shape of the fluid channel inlets 456*a-d* formed in the water supply connector 416. The valve core body 448 may be stepped inwardly around the valve core fluid outlet 420 to provide an engagement surface for the valve seal 440. Such a surface may aid in aligning the valve seal 440 with the valve core fluid outlet 420 when assembling the handheld showerhead 400.

With continued reference to FIGS. 24, 27, and 28, an upper valve core sidewall 458 may extend from the upper valve core flange 450. At least a portion of the upper valve core sidewall 458 may have a width approximately matching the upper valve flange's width, thus forming a valve core stop 460. The valve core stop 460 may engage a corresponding surface on the water supply connector 416, thus limiting the relative rotation between the valve core 418 and the water suppler connector 416. The valve core stop 460 serves a function similar to the stops described above for the first and second embodiments.

Figure 29:
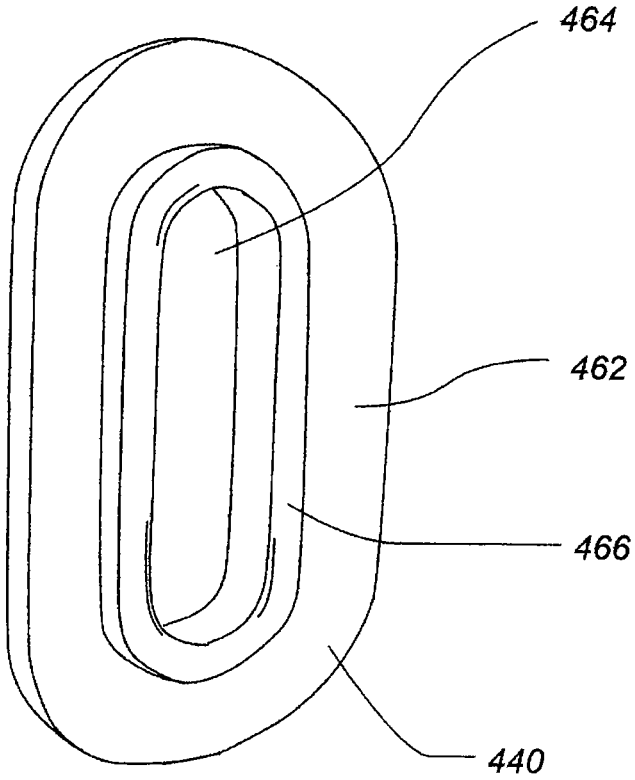
FIG. 29 is a perspective view of the valve seal for the handheld showerhead depicted in FIG. 21.

Turning to FIGS. 24, 27, and 29, the valve seal 440 may include a generally oval-shaped valve seal body 462, or other shaped body, defining a generally oval shaped valve seal aperture 464, which may approximately match the shape of the fluid chamber inlets 456*a-d* defined in the water supply connector 416. Around the valve seal aperture 464, a generally oval shaped valve seal sidewall 466, or other shaped sidewall, may extend from the valve seal body 462 for receipt within the valve core fluid outlet 420.

With reference to FIGS. 24 and 27, upper and lower annular water supply connector grooves 470 may be formed in water supply connector 416 near upper and lower portions of the valve core 418 to receive upper and lower O-rings 472, 474. The upper and lower O-rings 472, 474 prevent water leakage through the joint formed between the water supply connector 416 and the valve core 418. In some embodiments, the grooves for receiving the O-rings 472, 474 may be formed in the valve core 418, or in both the valve core 418 and the water supply connector 416.

FIGS. 30-37 depict a fourth embodiment of a handheld showerhead 500 with mode control. The fourth embodiment generally operates in a manner similar to the first embodiment. More particularly and with reference to FIGS. 30 and 31, the fourth embodiment may include a showerhead portion (not shown) with up to four sets of nozzles or openings providing up to four distinct showerhead spray modes, and a mode selector 502 serving as handle portion and selectively movable relative to a water supply connector 504 to select a showerhead spray mode.

Although the fourth embodiment operates in a similar manner to the previously described embodiments, individual components may be slightly modified. For example, the handle portion and the mode selector 502 may be a single component. As another example, the mode selector 502 slides along the longitudinal axis of the water supply connector 504.

The showerhead portion for the fourth embodiment is omitted. However any showerhead portion, including any described above, having fluid channels (which may be formed within the showerhead portion, or by using elements, such as hoses, tubes or the like, or by some combination thereof) arranged to fluidly communicate with the fluid channels defined in an upper portion of the water supply connector 504 may be used for the showerhead portion.

Turning to FIG. 30-37, the water supply connector 504 may include a generally cylindrical water supply connector shaft 506 separated into upper and lower water supply connector portions 508, 510. A bottom portion of the lower water supply connector portion 510 may be externally threaded for threadedly joining the water supply connector 504 to a shower hose or the like. The lower water supply connector portion 510 may define a fluid passage 512 for conveying fluid through lower portion of the water supply connector 504. The fluid passage 512 may fluidly connect a water supply connector fluid inlet 514 defined by the bottom portion of the water supply connector 504 with a water supply connector fluid outlet 516 defined in the water supply connector shaft 506.

The upper water supply connector portion 508 may define two or more upper fluid chambers 518*a-d*. Although four upper fluid chambers 518*a-d* are depicted in the figures, there may be more or less than four such chambers. Each upper fluid chamber 518*a-d* may be fluidly connected to a fluid chamber inlet 520*a-d*. Each fluid chamber inlet 520*a-d* may be formed at a different axial and radial position along the axial length of the upper water supply connector portion 508 as shown best in FIGS. 37 and 38. In some embodiments, one or more of the fluid chamber inlets 520*a-d* may be positioned at approximately the same radial position along the upper water supply connector portion 518. Positioning the fluid chamber inlets 520*a-d* at differing radial locations along the axial length of the upper water supply connector portion 508 may increase the overall material strength of the upper water supply connector portion 508 compared to aligning one or more of the fluid chamber inlets 520*a-d* along one radial section of the upper water supply connector portion 508.

Fluid communication between the water supply connector fluid outlet 516 and a fluid chamber inlet 520*a-d* may be selectively enabled or disabled using the mode selector 502. More particularly and with reference to FIGS. 32-35, the mode selector 502 may include an inner mode selector sidewall 522 spaced apart from an outer mode selector sidewall 524. Together, the inner and outer mode selector sidewalls 522, 524 along with the top and bottom ends of the mode selector 502 define a handle fluid chamber 526. A mode selector inlet 528 may be defined in the inner mode selector sidewall 522 and positioned near a bottom portion of the mode selector 502. The mode selector inlet 528 fluidly joins the fluid passage 512 in the lower portion of the water supply connector 504 to the handle fluid chamber 526.

One or more mode selector outlets 530*a-d* may be defined in the inner mode selector sidewall 522 and positioned in the portion of the mode selector 502 proximate the upper water supply connector portion 508. Further, each mode selector outlet 530*a-d* may be sized and positioned such that as the mode selector 502 moves relative to the water supply connector 504 along the water supply connector's longitudinal axis, each mode selector outlet 530*a-d* will at least partially align with at least one of the fluid chamber inlets 520*a-d*. When a mode selector outlet 530*a-d* at least partially aligns with a fluid chamber inlet 520*a-d*, fluid communication between this fluid chamber inlet 520*a-d* and the handle fluid chamber 526 is enabled, which in turn opens fluid communication between the fluid passage 512 and the upper fluid chamber 518*a-d* associated with the fluid chamber inlet 520*a-d*. The mode selector 502 may then be further moved to not at least partially align with the fluid chamber inlet 520*a-d*, thus ending the fluid communication between the fluid passage 512 and the upper fluid chamber 518*a-d*.

FIGS. 32-35 depict various cross-sectional views of the handheld showerhead 500 showing the mode selector 502 in an upper position and a lower position. Four mode selector outlets 530*a-d* are depicted in the figures, each outlet 530*a-d* positioned at approximately the same elevation on the mode selector 502. If desired, one or more of the four mode selector outlets 530*a-d* may be combined to form less than four outlets. For example, the four mode selector outlets 530*a-d* may be combined by defining an annular opening within the mode selector 502, thus effectively forming a single outlet.

Figure 32:
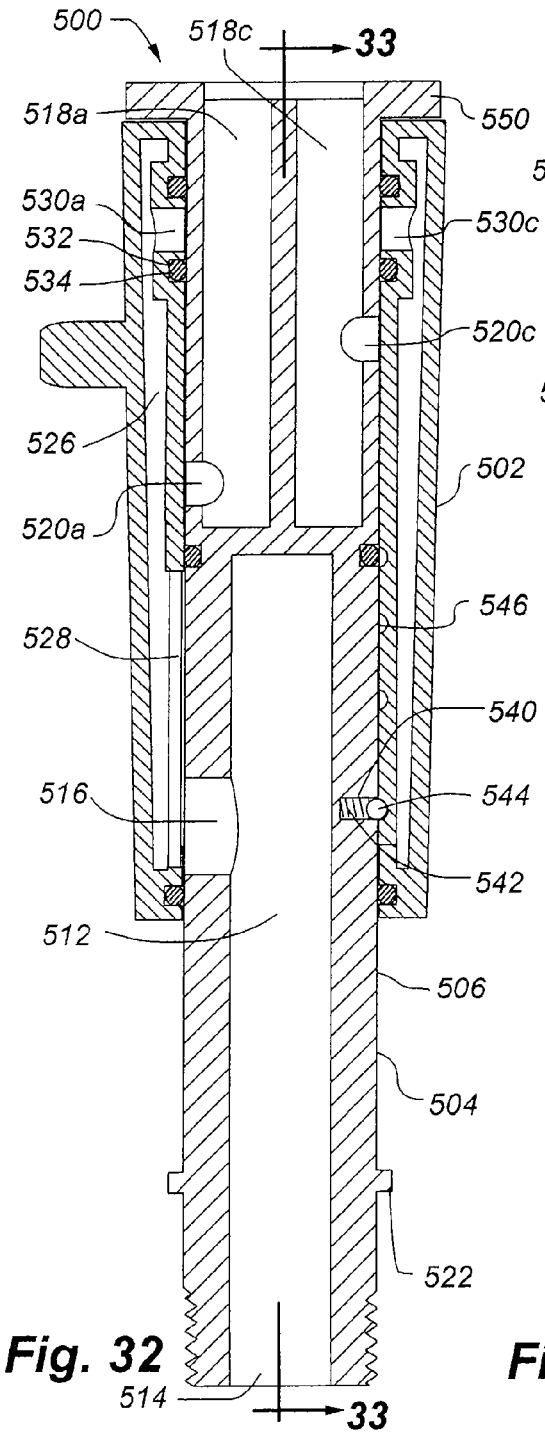
FIG. 32 is a cross-sectional view of the handheld showerhead depicted in FIG. 30, taken along line 32-32 in FIG. 30.
Figure 33:
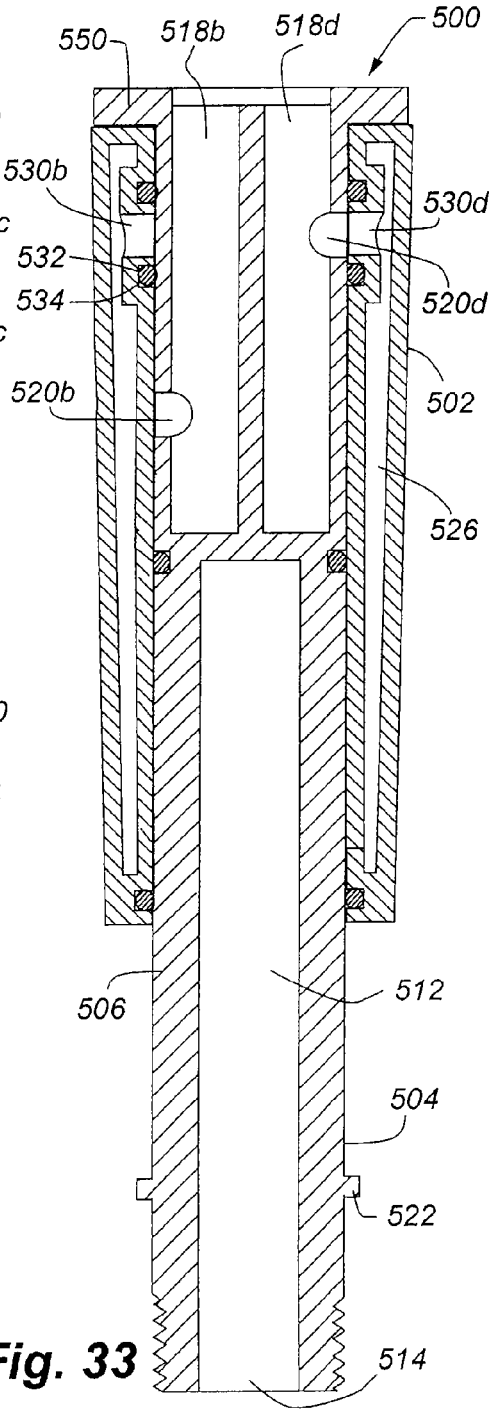
FIG. 33 is a cross-sectional view of the handheld showerhead depicted in FIG. 30, taken along line 33-33 in FIG. 32.
Figure 34:
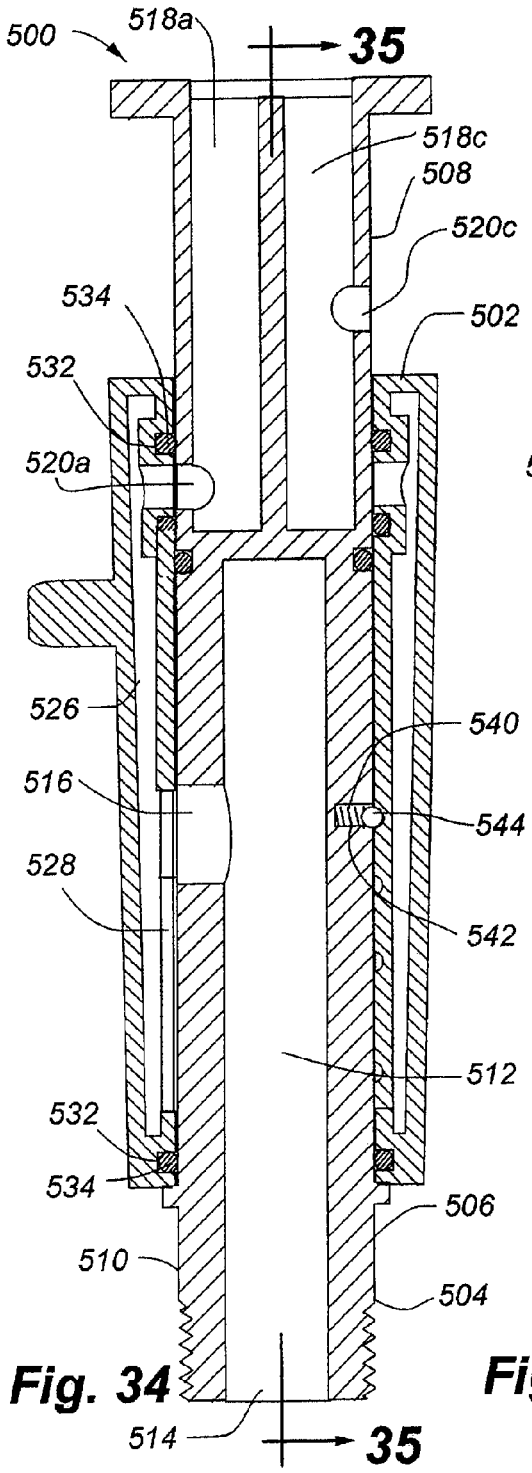
FIG. 34 is a cross-sectional view of the handheld showerhead depicted in FIG. 30, taken along line 34-34 in FIG. 31.
Figure 35:
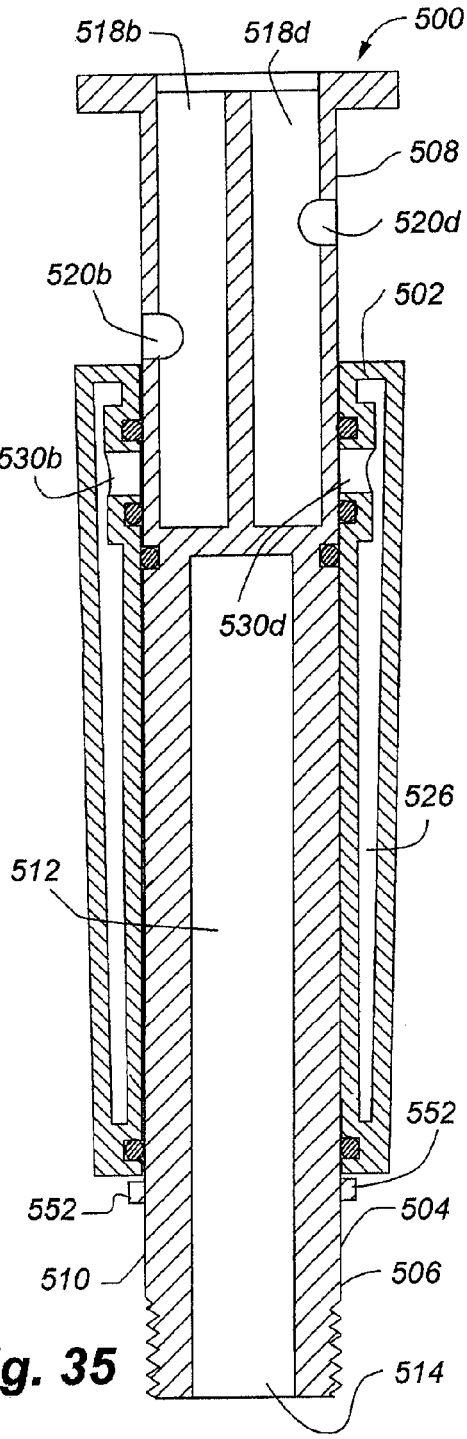
FIG. 35 is a cross-section view of the handheld showerhead depicted in FIG. 30, taken along line 35-35 in FIG. 34.
Figure 36:
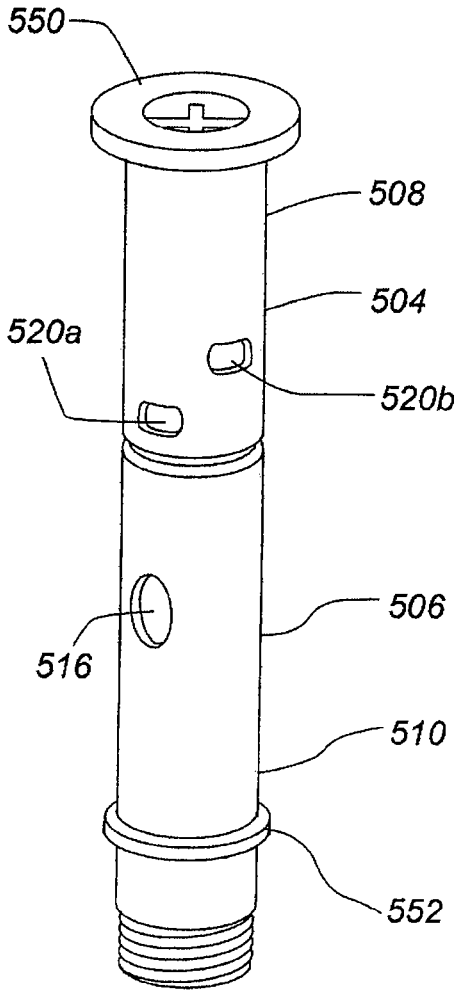
FIG. 36 is a front perspective view of the water supply connector for handheld showerhead depicted in FIG. 30.
Figure 37:
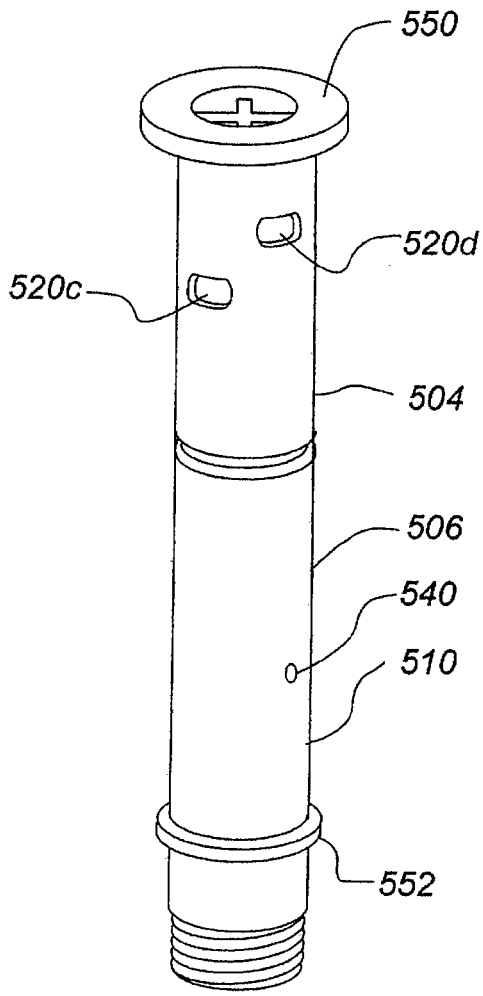
FIG. 37 is a rear perspective view of the water supply connector for handheld showerhead depicted in FIG. 30.

As shown in FIGS. 32 and 33, when the mode selector 502 is moved into the upper position, one of the mode selector outlets 530*a-d* may align with the uppermost fluid chamber inlet 520*d*, thus fluidly connecting the handle fluid chamber 526 with the upper fluid chamber 518*d* associated with the uppermost fluid chamber inlet 520*d*. Other fluid chamber inlets 520*a-c* along the water supply connector 504 are covered by the mode selector 502, thus preventing fluid communication between their associated upper fluid chambers 518*a-c* and the handle fluid chamber 526. To change the showerhead spray mode to another mode, the mode selector 502 may be moved to a second position, such as the lower position shown in FIGS. 34 and 35.

In the lower position, another of the mode selector outlets 530*a-d* may align with the lowermost fluid chamber inlet 520*a*, thus fluidly connecting the handle fluid chamber 526 with the upper fluid chamber 518*a* associated with the lowermost fluid chamber inlet 520*a*. One or more of the other fluid chamber inlets 520*b-d* may no longer be covered by the mode selector 502, such as shown in the figures, or may be covered by the mode selector 502, thus preventing fluid communication between their associated upper fluid chambers 518*b-d* and the handle fluid chamber 526. Check valves or other suitable one-way flow structures (not shown) may be positioned within, or joined to, the fluid chamber inlets 520*a-d* to prevent fluid from flowing out of their associated upper fluid chambers 518*a-d* when the fluid chamber inlets 520*a-d* are not covered by the mode selector 502. Also, although three of the fluid chamber inlets 520*a-d* are shown as uncovered by the mode selector 502 when moved to a lower position, the mode selector 502, the water supply connector 504, the mode selector outlets 530*a-d*, and the fluid chamber inlets 520*a-d* may be configured to ensure each fluid chamber inlet 520*a-d* remains covered for all operational positions of the mode selector 502 relative to the water supply connector 504.

In sum, a fluid, such as water, flows into the water supply connector's fluid passage 512 from a fluid hose via the water supply connector fluid inlet 514. Fluid then flows to the handle fluid chamber 526 through the water supply connector fluid outlet 516 and the mode selector inlet 528. From the handle fluid chamber 526, fluid flows to an upper fluid chamber 518*a-d* when a mode selector outlet 530*a-d* at least partially aligns with the fluid chamber inlet 520*a-d* associated with the upper fluid chamber 518*a-d*. Finally, fluid flows through the showerhead nozzles or openings via a fluid channel fluidly joined to the upper fluid chamber 518*a-d*. Moving the mode selector 502 relative to the water supply connector 504 changes which fluid chamber inlet 520 the mode selector outlet or outlets 530*a-d* align with, thus changing which nozzles or openings deliver water from the showerhead.

With further reference to FIGS. 32-35, grooves 532 for receiving O-rings 534 or other seal elements may be formed above and below the mode selector outlets 530*a-d* and the lower portion of the mode selector 502 to prevent fluid from leaking between the mode selector 502 and the water supply connector 504. In some embodiments, the grooves for receiving O-rings 534 may be formed in the water supply connector 504, in lieu of, or in combination with, the grooves formed in the mode selector 502, to fluidly seal the joints between the mode selector 502 and the water supply connector 504.

The water supply connector shaft 506 may define a spring opening 540 for receiving a spring 542 to bias a ball 544 (or other element, such as the plunger described above) against the mode selector 502. Ball grooves 546, corresponding to alignments of mode selector outlets 530*a-d* with fluid chamber inlets 520*a-d*, may be formed in the mode selector 502 to receive the ball 544 when a ball groove 546 aligns with the spring opening 540. Receipt of the ball 544 within the ball groove 546 provides a physical indication when a spray mode is selected by the user in a manner similar to the one described above for the other embodiments with respect to the plunger. Receipt of the ball 544 within the ball groove 546 may also minimize unintended movement of the mode selector 502 relative to the water supply connector 504 in a manner similar to the one described above for other embodiments with respect to the plunger. Other means, methods, or structures for providing an indication of when a mode is selected, or for preventing inadvertent movement of the mode selector 502 relative to the water supply connector 504, may be used in combination with, or in lieu of, the described ball and spring arrangement.

Upper and lower stops 550, 552 may be positioned on the water supply connector 504 to limit the upper and lower movement of the mode selector 502 relative to the water supply connector 504. The upper and lower stops 550, 552 may take the form of upper and lower flanges extending outwardly from the water supply connector shaft 506 as shown in FIGS. 30-37, or take the form of another structure, such as a tab. The upper and lower stops 550, 552 may be integrally formed with the water supply connector shaft 506 or may be separate components joined by friction fit, heat or sonic welding, adhesives, mechanical fasteners, other connecting methods, or any combination thereof.

Figure 30:
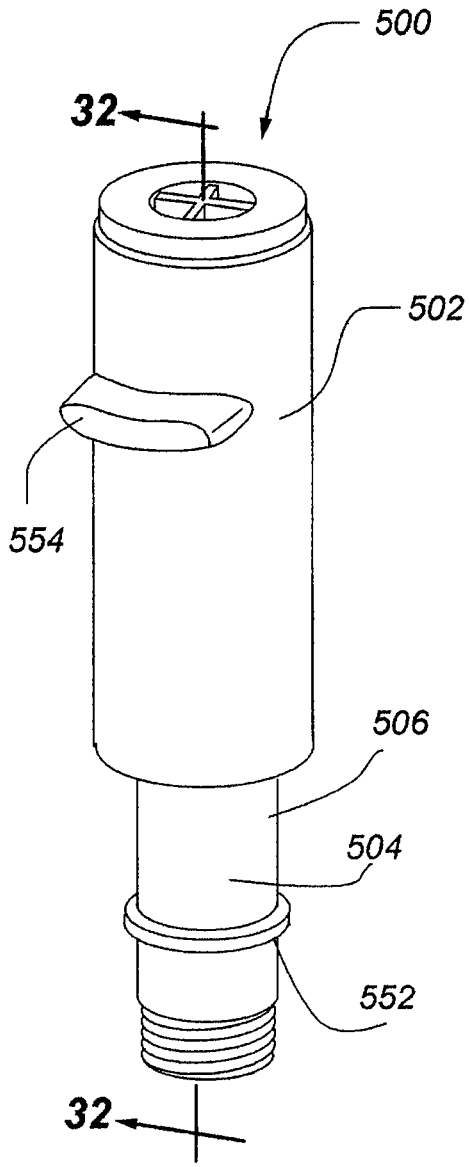
FIG. 30 is a front perspective view of a fourth embodiment handheld showerhead with the showerhead omitted.
Figure 31:
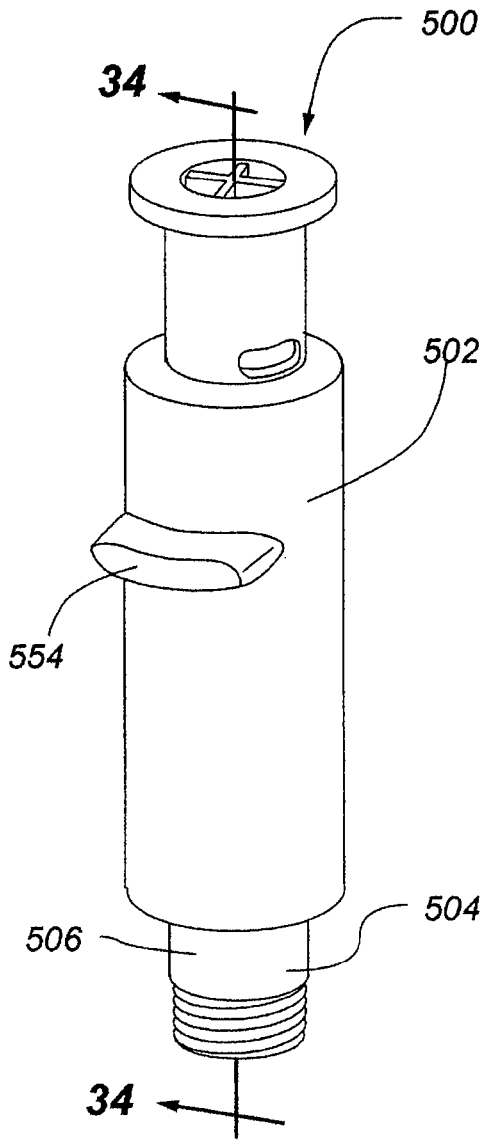
FIG. 31 is another front perspective view of the handheld showerhead depicted in FIG. 30, showing the mode control in a second position.

With references to FIGS. 30 and 31, a hand gripping feature 554 may extend outwardly from the mode selector sidewall. A user may hold the hand gripping feature 554 when sliding the mode selector 502 relative to the water supply connector 504. The hand gripping feature 554 may have a generally oval-shaped, or any other suitable shape, to facilitate a user gripping the feature 554.

The components of the handheld showerhead for any of the various embodiments described above, including, but not limited to, the showerhead portion, the handle portion, the mode selector, the plunger, the spring, the seal elements, the nozzles, the water supply connector, and so on, may be composed of any suitable material, including, but not limited to, metals, ceramics, rubbers, plastics, and the like. Further, each of the components may be formed from a single element, or from multiple elements suitably joined together.

All directional references (e.g., upper, lower, upward, downward, left, right, leftward, rightward, top, bottom, above, below, inner, outer, vertical, horizontal, clockwise, and counterclockwise) are only used for identification purposes to aid the reader's understanding of the example of the invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A handheld showerhead, comprising a showerhead portion including a plurality of nozzles;

at least two fluid channels in fluid communication with respective subsets of the plurality of nozzles, wherein the at least two fluid channels are defined in part by at least two walls that are adjacent and parallel to each other and a curved wall that extends between edges of the at least two walls and along a longitudinal dimension of the at least two walls;

a base wall defining two or more fluid channel inlets each in fluid communication with a respective one of the at least two fluid channels;

a handle portion operatively associated with the showerhead portion, including at least one of a fluid inlet and a fluid passage; and a movable mode selector wherein movement of the mode selector selectively places the fluid inlet or the fluid passage of the handle portion in fluid communication with one of the at least two fluid channels via a respective one of the fluid channel inlets.

2. The handheld showerhead of claim 1, wherein the showerhead portion includes the at least two fluid channels.

3. The handheld showerhead of claim 2, wherein the mode selector includes a fluid aperture in fluid communication with the fluid inlet or fluid passage and rotation of the mode selector selectively places the fluid aperture of the mode selector in fluid communication with one of the at least two fluid channels.

4. The handheld showerhead of claim 3, wherein the mode selector includes a fluid chamber in fluid communication with the fluid inlet or the fluid passage and movement of the mode selector selectively places the fluid chamber in fluid communication with at least one of the at least two fluid channels.

5. The handheld showerhead of claim 1, wherein the handle portion further includes a water supply connector.

6. The handheld showerhead of claim 1, wherein the mode selector moves about a longitudinal axis of the handle portion.

7. The handheld showerhead of claim 1, wherein the mode selector further moves substantially parallel to a longitudinal axis of the handle portion.

8. The handheld showerhead of claim 1, wherein the mode selector comprises a finger grip feature.

9. The handheld showerhead of claim 8, wherein the finger grip feature includes at least one of a finger grip recess or a finger grip projection.

10. The handheld showerhead of claim 1, wherein the at least two walls are defined in the showerhead portion.

11. The handheld showerhead of claim 1, wherein the handle portion further includes at least one fluid channel in fluid communication with at least one of the at least two fluid channels.

12. The handheld showerhead of claim 1, wherein at a transition point the at least two walls transition from being parallel to each other to being not substantially parallel to each other.

13. The handheld showerhead of claim 1, wherein the movable mode selector further comprises a control knob mounted about the handle portion and configured to rotate about an axis; and a rotatable selection structure that defines an aperture that is in fluid communication with the fluid inlet; and wherein rotation of the control knob rotates the selection structure and selectively aligns the aperture in the selection structure with one of the two or more fluid channel inlets in the base wall to direct water flow from the fluid inlet to one of the at least two fluid channels.

14. The handheld showerhead of claim 13, wherein the axis of rotation of the control knob is parallel to the handle portion.

15. The handheld showerhead of claim 13, wherein the aperture in the selection structure is positioned on a top face of an annular ring extending from the selection structure.

16. The handheld showerhead of claim 13, wherein the control knob is positioned between a bottom portion of the handle portion and the showerhead portion.

17. The handheld showerhead of claim 1, further comprising a turbine positioned within at least one of the at least two fluid channels.

18. A handheld showerhead comprising a showerhead portion including at least two fluid channels, wherein the at least two fluid channels are defined in part by at least two walls that are adjacent and parallel to each other and a curved wall that extends between edges of the at least two walls and along a longitudinal dimension of the at least two walls;

a base wall formed at a first end of each of the at least two fluid channels and defining two or more fluid inlets each in fluid communication with a respective one of the two or more fluid channels; and a handle portion operatively associated with the showerhead portion, the handle portion including a fluid passage; and a rotatable mode selector; wherein the showerhead portion is positioned relative to the handle portion such that a fluid exiting the showerhead portion under operational flow conditions initially moves primarily in a direction that forms a right angle or an acute angle with respect to a longitudinal axis of the handle portion; and rotation of the mode selector selectively places the fluid inlet or the fluid passage in fluid communication with one of at least two fluid channels.

19. The handheld showerhead of claim 18, wherein the at least two fluid channels comprise three fluid channels.

20. The handheld showerhead of claim 18, at a transition point the at least two walls transition from being parallel to each other to being not substantially parallel to each other.

21. The handheld showerhead of claim 18, wherein the control mode selector further comprises a cylindrical body defining an aperture on a first side of the body;

a stop member extending from the cylindrical body configured to engage with a sidewall of the handle portion to prevent rotation of the control mode selector in at least one direction; and wherein rotating the control mode selector rotates the cylindrical body placing the aperture in fluid communication with at least one of the two or more fluid inlets in the base wall.

* * * * *